US012722671B2

(12) United States Patent
Yorke et al.

(10) Patent No.: US 12,722,671 B2
(45) Date of Patent: Sep. 1, 2026

(54) TRAIN WARNING SYSTEM FOR RAIL OPERATIONS

(71) Applicant: BLUE-BAND LLC, Sanford, FL (US)

(72) Inventors: Kevin D. Yorke, Deltona, FL (US); Roberto C. Adair, Oveido, FL (US)

(73) Assignee: Blue-Band LLC, Sanford, FL (US)

( * ) Notice: Subject to any disclaimer, the term of this patent is extended or adjusted under 35 U.S.C. 154(b) by 796 days.

(21) Appl. No.: 18/164,135

(22) Filed: Feb. 3, 2023

(65) Prior Publication Data

US 2023/0242164 A1 Aug. 3, 2023

Related U.S. Application Data

(60) Provisional application No. 63/306,345, filed on Feb. 3, 2022.

(51) Int. Cl.
*B61L 23/00* (2006.01)

(52) U.S. Cl.
CPC ..... *B61L 23/00* (2013.01); *B61L 2207/02* (2013.01)

(58) Field of Classification Search
CPC ..... B61L 29/28; B61L 2207/02; B61L 23/00; B61L 23/06; B61L 29/18; B61L 25/02; B61L 25/021; B61L 25/023; B61L 25/028; B61L 2207/00; B61L 23/26; B61L 23/22; B61L 13/00; B61L 13/002; B61L 13/005; B61L 13/007; B61L 13/02; B61L 9/04; B61L 9/00; G08G 1/01; G08G 1/0116; G08G 1/012; G08G 1/0133; G08G 1/0141; F21W 2111/02
USPC ..... 246/292, 293, 294, 295, 473.1, 473.3, 246/474, 473 R, 477
See application file for complete search history.

(56) References Cited

U.S. PATENT DOCUMENTS 5,864,304 A * 1/1999 Gerszberg ..... B61L 29/18 246/126
2005/0270175 A1* 12/2005 Peddie ..... G08G 1/096783 246/473 R

FOREIGN PATENT DOCUMENTS

WO WO-2008107141 A1 * 9/2008 ..... B61K 13/00

* cited by examiner

*Primary Examiner* — S. Joseph Morano
*Assistant Examiner* — Heaven R Buffington
(74) *Attorney, Agent, or Firm* — Dority & Manning, P.A.

(57) ABSTRACT

A computing device communicatively coupled to a light assembly that is coupled to a railroad track and that is operable to emit light in a plurality of different colors, determines a current train state of a plurality of different train states at a first location. In response to determining that the current train state is a first train state of the plurality of different train states, the computing device causes the light assembly to emit a first color of the plurality of different colors emittable by the light assembly.

20 Claims, 9 Drawing Sheets

TRAIN WARNING SYSTEM FOR RAIL OPERATIONS

RELATED APPLICATION

This application claims priority to U.S. Provisional Patent Application No. 63/306,345, filed on Feb. 3, 2022, entitled "INTELLIGENT WARNING SYSTEM FOR RAIL OPERATIONS," which is hereby incorporated herein by reference in its entirety.

BACKGROUND

Collisions between trains and objects, including humans and vehicles, result in hundreds of fatalities and thousands of injuries annually. Crossing signals are relatively costly and consequently are only typically installed at relatively high-traffic intersections, and are not installed at the vast majority of railroad crossings in rural areas. Moreover, people and vehicles frequently cross railroad tracks where there is no intersection with a road.

SUMMARY

The embodiments disclosed herein implement a train warning device that includes a light assembly that is coupled to a railroad track and emits a color of light based on a train state at that railroad track location.

In one embodiment a method is provided. The method includes determining, by a computing device communicatively coupled to a light assembly that is coupled to a railroad track and that is operable to emit light in a plurality of different colors, a current train state of a plurality of different train states at a first location. The method further includes, in response to determining that the current train state is a first train state of the plurality of different train states, causing the light assembly to emit a first color of the plurality of different colors emittable by the light assembly.

In another embodiment a train warning system is provided. The train warning system includes a light assembly operable to emit light in a plurality of different colors, the light assembly being configured to be coupled to a railroad track at a first location. The train warning system further includes a first computing device communicatively coupled to the light assembly, the computing device operable to determine a current train state at the first location, wherein the current train state is a first train state. The computing device is further operable to, in response to determining that the current train state is the first train state, cause the light assembly to emit a first color of the plurality of different colors emittable by the light assembly.

In another embodiment a non-transitory computer-readable storage medium is provided. The non-transitory computer-readable storage medium includes executable instructions operable to cause a processor device to determine a current train state of a plurality of different train states at a first location. The instructions are further operable to cause the processor device to, in response to determining that the current train state is a first train state of the plurality of different train states, cause a light assembly that is coupled to a railroad track and that is operable to emit light in a plurality of different colors to emit a first color of the plurality of different colors emittable by the light assembly.

Individuals will appreciate the scope of the disclosure and realize additional aspects thereof after reading the following detailed description of the examples in association with the accompanying drawing figures.

BRIEF DESCRIPTION OF THE DRAWINGS

The accompanying drawing figures incorporated in and forming a part of this specification illustrate several aspects of the disclosure and, together with the description, serve to explain the principles of the disclosure.

DETAILED DESCRIPTION

Figure 1:
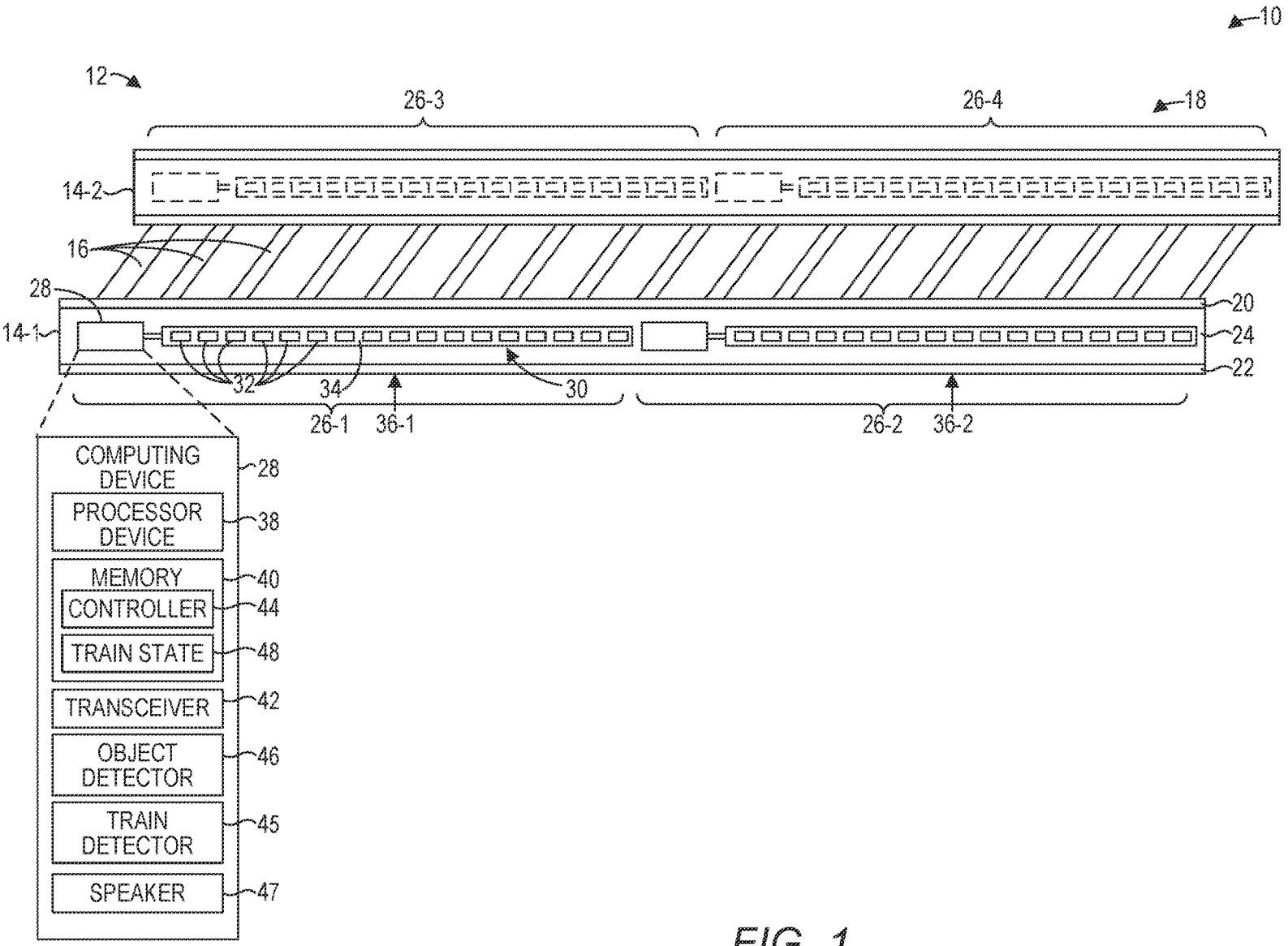
FIG. 1 is a block diagram of an environment that includes a train warning system according to one embodiment.

The examples set forth below represent the information to enable individuals to practice the examples and illustrate the best mode of practicing the examples. Upon reading the following description in light of the accompanying drawing figures, individuals will understand the concepts of the disclosure and will recognize applications of these concepts not particularly addressed herein. It should be understood that these concepts and applications fall within the scope of the disclosure and the accompanying claims.

Any flowcharts discussed herein are necessarily discussed in some sequence for purposes of illustration, but unless otherwise explicitly indicated, the examples are not limited to any particular sequence of steps. The use herein of ordinals in conjunction with an element is solely for distinguishing what might otherwise be similar or identical labels, such as "first message" and "second message," and does not imply an initial occurrence, a quantity, a priority, a type, an importance, or other attribute, unless otherwise stated herein. The term "about" used herein in conjunction with a numeric value means any value that is within a range of ten percent greater than or ten percent less than the numeric value. As used herein and in the claims, the articles "a" and "an" in reference to an element refers to "one or more" of the element unless otherwise explicitly specified. The word "or" as used herein and in the claims is inclusive unless contextually impossible. As an example, the recitation of A or B means A, or B, or both A and B. The word "data" may be used herein in the singular or plural depending on the context. The use of "and/or" between a phrase A and a phrase B, such as "A and/or B" means A alone, B alone, or A and B together.

Collisions between trains and objects, including humans and vehicles, result in hundreds of fatalities and thousands of injuries annually. Crossing signals are relatively costly and consequently are only typically installed at relatively high-traffic intersections, and are not installed at the vast majority of railroad crossings in rural areas. Moreover, people and vehicles frequently cross railroad tracks where there is no intersection with a road.

The embodiments disclosed herein implement a train warning device that includes a light assembly that is coupled to a railroad track and emits a color of light based on a current train state at that railroad track location. In some embodiments, if no train is expected at the railroad track location within a predetermined amount of time, a first color, such as green, may be continuously emitted by the train warning device. In some embodiments, the light may be emitted only when an object, such as a pedestrian is near the railroad track location. In other embodiments, the light may be emitted continuously irrespective of the detection of a pedestrian or other object.

The current train state at the railroad track location is continuously determined. The determination may be made in response to a determination of a location of an oncoming train, and/or in response to the receipt of a message that identifies the current train state.

As an example, the current train state at the railroad track location may change to a first train state in response to an oncoming train being at least a predetermined distance from the location, or in response to a first message that identifies the first train state. In response, the train warning device may emit yellow light. Subsequently, the current train state at the railroad track location may change to a second train state wherein an oncoming train is determined to be within a predetermined distance of the railroad track location, or in response to a second message that identifies the second train state, and the train warning device may emit a red light.

FIG. 1 is a block diagram of an environment 10 that includes a train warning system 12 according to one embodiment. The environment 10 includes two steel rails 14-1 and 14-2 (generally, steel rails 14) that are coupled to a plurality of railroad ties 16. The steel rails 14 and railroad ties 16 form a railroad track 18 upon which a train may travel. The steel rails 14 include a head 20, a foot 22 and a web 24 connected to the head 20 and the foot 22. The train warning system 12 includes one or more train warning devices 26-1-26-4 (generally, train warning devices 26). Each of the train warning devices 26 may be configured substantially identically. The train warning devices 26-1 and 26-2 provide warnings to objects on one side of the railroad track 18, and the train warning devices 26-3 and 26-4 provide warnings to objects on the other side of the railroad track 18. The train warning device 26-1 includes a computing device 28 and a light assembly 30 to which the computing device 28 is communicatively coupled. The light assembly 30 comprises one or more lights 32 and is operable to emit visible light in a plurality of colors. The light assembly 30 in this example comprises a light strip 34 that comprises the plurality of lights 32. The lights 32 may comprise LED lights, such as red, green, blue (RGB) LED lights and/or red, green, blue, white (RGBW) LED lights. The lights 32 may individually be able to emit different colors of visible light, or the lights 32 may comprise multiple sets of lights, each set of lights being operable to emit light in a different color. The train warning device 26-1 may be powered in any suitable manner, including, by way of non-limiting example, kinetic energy, battery, solar, thermal energy and/or 120*v* power service, or a combination of these power sources to provide power and back up functionality as a redundant option.

The light assembly 30 is coupled to the railroad track 18. In particular, the light assembly 30 is coupled to the web 24 of the steel rail 14-1. The light assembly 30 may be coupled to the web 24 in any number of ways, including, by way of non-limiting example, high-power magnets, male and female quick-release clips, bolts, fasteners or the like. In some embodiments, the light assembly 30 may be removably coupled to the web 24 to facilitate simple maintenance or replacement. The computing device 28 may also be coupled to the web 24 or in otherwise close proximity to the light assembly 30. If coupled to the web 24, a similar mechanism discussed above with regard to the light assembly 30 may be used.

The light assembly 30 is coupled to the railroad track 18. The computing device 28 includes a processor device 38, a memory 40, and one or more transceivers 42. The transceivers 42 may include one or more of a cellular transceiver, a Wi-Fi® transceiver, a wired transceiver, a Bluetooth® or other short-range wireless transceiver, and the like. The memory 40 includes a controller 44 that operates to provide certain functionality described herein.

The computing device 28 may include or be communicatively coupled to a train detector 45 that is operable to detect a train at the railroad track location. The train detector 45 may be triggered by audio, video, laser/radio wave, vibrations, or specialized sensors and is operable to determine that a train has arrived at the railroad track location.

The computing device 28 may include or be communicatively coupled to an object detector 46 that is operable to detect movement of and distances to one or more objects, such as humans, vehicles, or the like. The computing device 28 may also include a speaker 47. The train warning devices 26-2-26-4 are configured substantially similarly to the train warning device 26-1.

The controller 44 continuously, such as periodically, intermittently, or in response to some event, determines a train state 48 at a location 36-1 of the railroad track 18. The location 36-1 may be at or near the location where the light assembly 30 is coupled to the railroad track 18. The location 36-1 may be identified in absolute terms, such as a GPS location, or relative to another location, such as a distance from some other known location, or a number of "hops" from some other train warning device 26. The controller 44 may cause the light assembly 30 to continuously emit light in a certain color based on the train state. The train state 48 reflects a risk associated with an attempted crossing of the railroad track 18 at the location 36-1. If the risk is low, such as if there are no known oncoming trains, or if a known oncoming train is at least a first predetermined distance and/or a first amount of time from the location 36-1, the train state 48 may be determined to be an idle state. When the train state 48 is the idle state, the controller 44 may cause the light assembly 30 to emit a first color of light, such as a green color.

A low to moderate risk may be associated with an oncoming train that is at least a second predetermined distance and/or a second amount of time from the location 36-1. In this situation, the train state 48 may be determined to be a leading state. When the train state 48 is the leading state, the controller 44 may cause the light assembly 30 to emit a second color of light, such as a yellow color.

A high risk may be associated with an oncoming train that is within a third predetermined distance and/or within a third calculated time interval away from the location 36-1. In this situation, the train state 48 may be determined to be an occupied state. When the train state 48 is the occupied state, the controller 44 may cause the light assembly 30 to emit a third color of light, such as a red color. In practice, the controller 44 may typically cause the light assembly 30 to emit the first color when no train is expected or is sufficiently far away in distance and/or time, subsequently determine that the train state 48 is the leading state, causing the light assembly 30 to emit the second color, subsequently determine that the train state 48 is the arriving train state, causing the light assembly 30 to emit the third color, and, after the train has passed the location 36-1, determine that the train state 48 is again the idle state, causing the light assembly 30 to emit the first color. In this manner, objects, such as humans and/or vehicles, are presented with an easy-to-understand visual indication quantifying a current risk of crossing the railroad track 18 at the location 36-1.

In one embodiment, the controller 44 may determine the train state 48 based on a message originating from a remote device. The train state 48 changes based on various events, as discussed in greater detail below. The train state 48 can be queried or set to reflect a current train state at the location 36-1. In one embodiment, the remote device may comprise a computing device that tracks real-time locations of trains on the railroad track 18. In particular, the controller 44 may, periodically, intermittently, or upon the occurrence of an event, receive a message that indicates a train is at a particular location on the railroad track 18. In some embodiments, the message may also indicate a current speed of the train. Based on the location and, optionally, the speed of the train, the controller 44 may determine the train state 48.

In other embodiments, as will be discussed in greater detail below, the railroad track 18 may be tens, hundreds, or thousands of miles long, and have tens, hundreds, thousands, or millions of train warning devices 26 coupled to the railroad track 18. The train warning devices 26 may continuously communicate with one another, such as by propagating messages among the computing devices 28, that identify where a train is at a particular instance in time, and in some embodiments, a speed of the train. Based on the messages, each train warning device 26 can determine a corresponding train state 48 at a corresponding location 36, and cause the light assembly 30 of the train warning device 26 to emit a particular color. The determination may be based on a determination of where the train currently is, or in response to the receipt of a message that informs the train warning device 26 to set the current train state 48 to a particular train state.

In some embodiments, the object detector 46 operates to detect objects in proximity to the railroad track 18. The object detector 46 may operate using any object detection technology, including, by way of non-limiting example, infrared technologies, audio technologies, vibration technologies, time of flight technologies, video processing technologies, LIDAR, sonar, or the like. In some embodiments, the computing device 28 may not cause the light assembly 30 to emit light unless an object has been detected in proximity to the railroad track 18 and then may stop emitting light after some predetermined period of time. In other embodiments, the computing device 28 may cause the light assembly 30 to emit light irrespective of whether an object has been detected in proximity to the railroad track 18. In other embodiments, only the train warning devices 26 that are within some predetermined distance from the oncoming train may emit light, and then stop emitting light at some point after the train has passed by the train warning devices 26. In some embodiments, the object detector 46 may be located a distance from the railroad track 18 and be communicatively coupled to the computing device 28.

In some embodiments, in conjunction with the object detector 46, the controller 44 may determine that an object is within a first predetermined distance of the railroad track 18. In response, the controller 44 may cause the light assembly 30 to emit a first warning light signal. The first warning light signal may comprise, for example, a pulsing of the color that corresponds to the train state 48 at a first pulse rate. In other embodiments, the first warning light signal may comprise, for example, a pulsing of a white light at a first pulse rate while concurrently emitting the color that corresponds to the train state 48, the color that corresponds to the train state 48 being emitted continuously or at the first pulse rate.

Subsequently, the controller 44 may determine that the object is within a second, closer predetermined distance of the railroad track 18, indicating that the object is moving toward the railroad track 18. In response, the controller 44 may cause the light assembly 30 to emit a second warning light signal. The second warning light signal may comprise, for example, a pulsing of the color that corresponds to the train state 48 at a second pulse rate that is a faster rate than the first pulse rate. In other embodiments, the second warning light signal may comprise, for example, a pulsing of a white light at the second pulse rate while concurrently emitting the color that corresponds to the train state 48, the color that corresponds to the train state 48 being emitted continuously or at the second pulse rate.

In some embodiments, the controller 44 may also cause a sound to be emitted from the speaker 47 in response to detecting an object in proximity to or approaching the railroad track 18.

It is noted that, because the controller 44 is a component of the computing device 28 and the train warning device 26-1, functionality implemented by the controller 44 may be attributed to the computing device 28 or the train warning device 26-1 generally. Moreover, in examples where the controller 44 comprises software instructions that program the processor device 38 to carry out functionality discussed herein, functionality implemented by the controller 44 may be attributed herein to the processor device 38.

Figure 2:
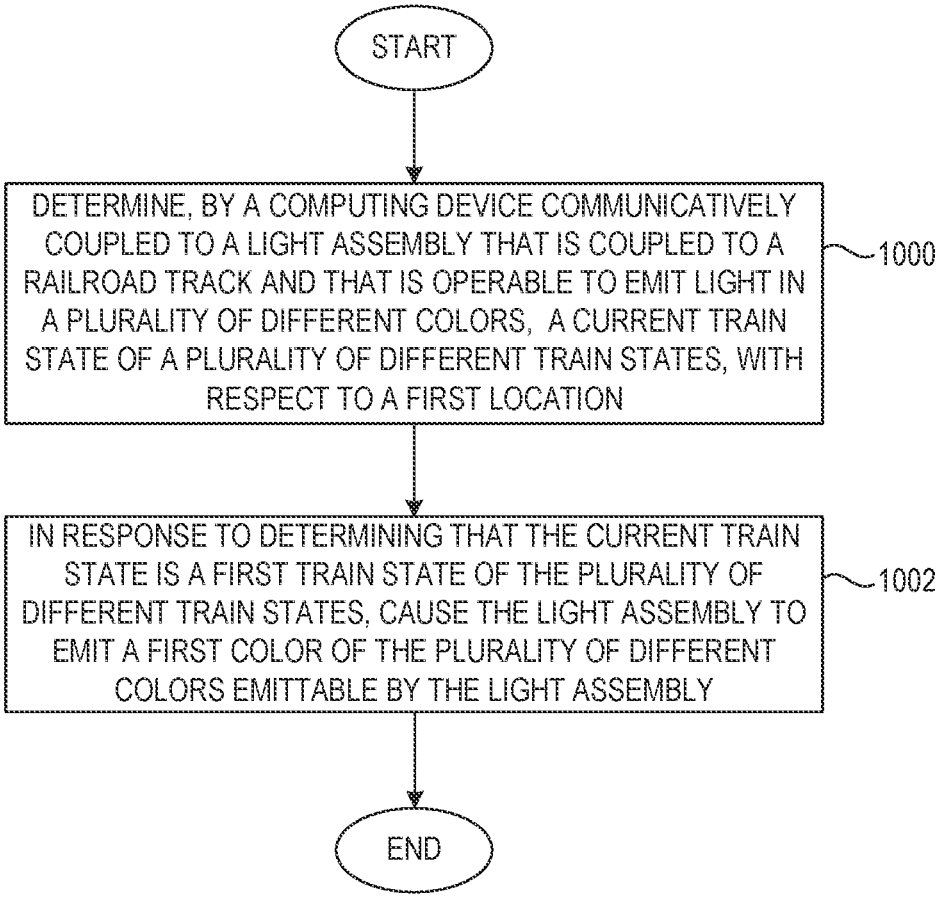
FIG. 2 is a method for a train warning system according to one embodiment.

FIG. 2 is a method for a train warning system according to one embodiment. FIG. 2 will be discussed in conjunction with FIG. 1. The computing device 28, communicatively coupled to the light assembly 30 that is coupled to the railroad track 18 and that is operable to emit light in a plurality of different colors, a current train state of a plurality of different train states, with respect to the location 36-1 (FIG. 2, block 1000). In response to determining that the current train state is a first train state of the plurality of different train states, the computing device 28 causes the light assembly 30 to emit a first color of the plurality of different colors emittable by the light assembly 30 (FIG. 2, block 1002).

Figure 3:
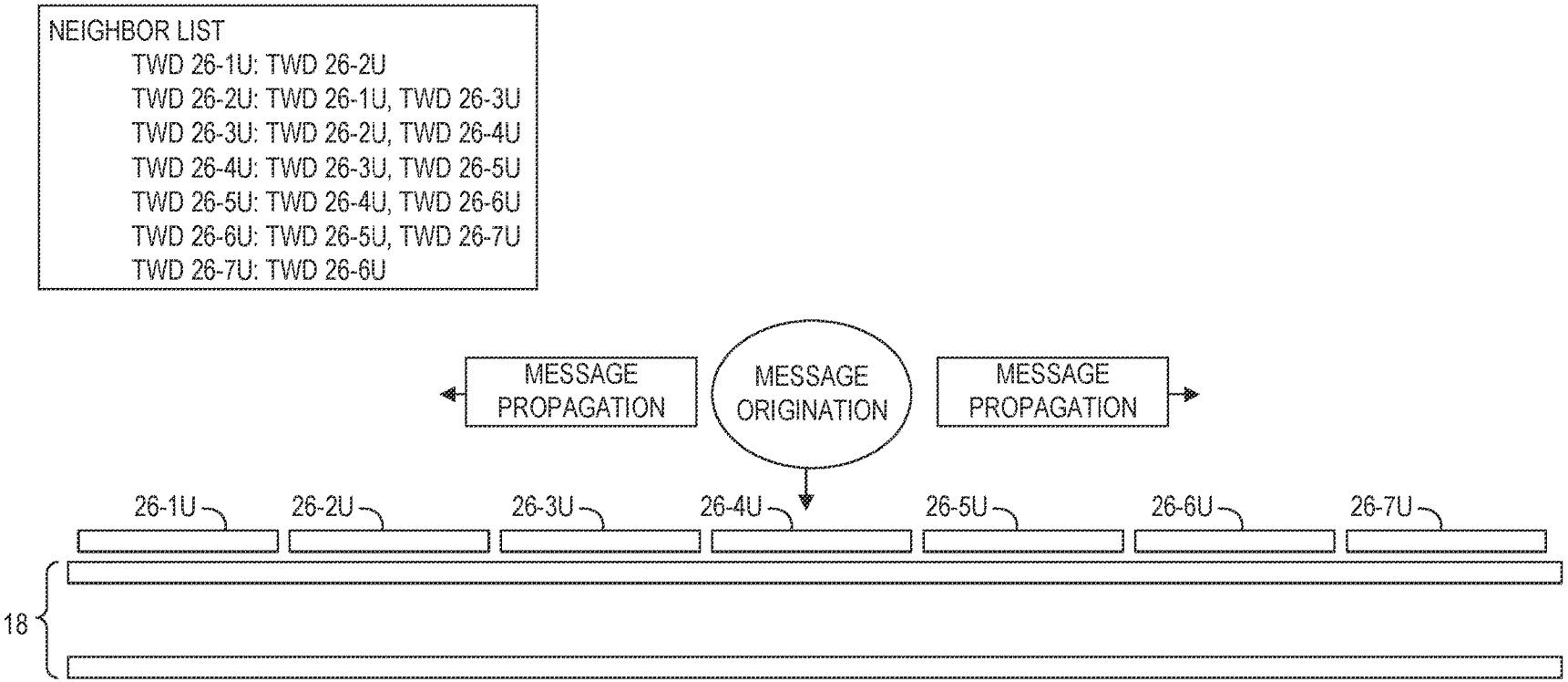
FIG. 3 is a schematic diagram illustrating message propagation among a plurality of warning devices coupled along a length of a railroad track according to one embodiment.

FIG. 3 is a schematic diagram illustrating a plurality of train warning devices 26-1U-26-7U coupled along one side of a length of the railroad track 18 according to one embodiment. In this embodiment, the train warning devices 26 use a wireless technology to propagate messages to adjacent train warning devices 26 on the same side of the railroad track 18. The train warning devices 26 on the same side of the railroad track 18 are sometimes referred to herein as being in the same "domain." A first train warning device 26 may determine what domain a second train warning device 26 belongs to based on one or more wireless specific parameters such as, by way of non-limiting example, channel, frequency, frequency width, and/or special identifiers (IDs).

Node Propagation Protocol

The train warning devices 26 may utilize a particular protocol to communicate, sometimes referred to herein as the Node Propagation Protocol (NPP). The term "node" as used herein refers to a train warning device 26. The protocol allows messages to propagate (i.e., hop) linearly to each train warning device 26 upstream, downstream, or in both directions, from its originating train warning device 26 and will continue to travel in the determined path(s) until a receiving train warning device 26 determines that message propagation shall stop. A train warning device 26 may determine that a message should stop propagating if either of two conditions are met: the message is addressed to the receiving train warning device 26 such that the message has reached its destination, or the hop count is 0, in which case the message has lived its maximum lifespan, or there is no next hop to make, such that the train warning device 26 does not have a next neighbor to whom to send the message (e.g., this is the end of the line). In this example, an originating train warning device 26-4U illustrates a train warning device 26 that has originated a message.

The train warning device 26-4U starts the propagation process of a message and determines propagation direction (s). A "hop train warning device 26" refers to any train warning device 26 that is not the originating train warning device 26 for a message and that receives a message. Each train warning device 26 prepares a message for transport and may include propagation protocol information in the message header that includes:

Destination: a value containing the intended recipient (train warning device 26) of the message, if any. A special value may be used to indicate a message is intended for all train warning devices 26. Another special value may be used to indicate that the message is not intended for any specific train warning device 26. Other special values may be assigned per application if needed, such as shared IDs. It is up to the originating train warning device 26 to determine the appropriate destination value. In some embodiments, no train warning devices 26 may alter this value as the message propagates.

Source: A value containing the source ID of the originating train warning device 26 of the message. The originating train warning device 26 will insert an ID of the originating train warning device 26. In some embodiments, no train warning devices 26 may alter this value as the message propagates.

Hop Count: A value that will be decremented each hop (e.g., receipt of the message by a neighboring train warning device 26) before transmitting to the next hop. Once a train warning device 26 receives a message that has a hop count of 0, the train warning device 26 may no longer propagate the message. The originating train warning device 26 may determine the initial value of the hop count depending on the message being transmitted.

Hop Source: A value containing the source of the hop message. Each train warning device 26 may update this value with its own ID before the train warning device 26 sends the message to the next hop (train warning device 26). If this is the originating train warning device 26, the originating train warning device 26 will insert its own ID here.

Hop Destination: A value containing the intended next train warning device 26 to receive the message. Each train warning device 26 may maintain information, referred to herein as neighbor information, of one or more neighboring train warning devices 26. Each hop train warning device 26 may determine what the hop destination value shall be by examining the neighbor information of the train warning device 26. The train warning device 26 may have a predetermined number of neighbor train warning devices 26, such as, by way of non-limiting example, 2 neighbors, which may be referred to herein as neighbor A and neighbor B. If the train warning device 26 receives a message from neighbor A, and the train warning device 26 determines that the message meets requirements to continue propagation, the train warning device 26 may send the message to neighbor B by setting the Hop Destination value to neighbor B. This process also works in the reverse direction, in which if a message is received from neighbor B and meets requirements for continued propagation, the train warning device 26 may set this value to neighbor A. The originating train warning device 26 shall set this value based on the direction it wishes the message to propagate: upstream (toward the direction of an oncoming train), downstream (away from the direction of an oncoming train), or in both directions. If this value is left empty, the message will propagate in both directions from the originating train warning device 26. Remaining information in the message may be the payload data being transported.

The train warning devices 26 may ignore all messages received, unless the hop next value is their own or the hop next value is empty, even if the destination value is one they would normally answer (such as being set to their address or a broadcast). One exception to this rule is if a train warning device 26 determines that the train warning devices 26 can take over the propagation of the message for Resilient Propagation purposes as discussed in greater detail below.

Status Messages

Periodically, all train warning devices 26 may broadcast a status message. The status message shall not propagate and shall only be received by train warning devices 26 within reception range. In the message header, hop next shall be set to empty and hop count shall be set to 0, so that all train warning devices 26 that receive the status message will process the status message but not propagate the status message. The intent of the status message is to broadcast state information about the train warning device 26 so that surrounding train warning devices 26 can keep their surrounding node lists up to date. The state information about the train warning device 26 can be application specific and makes no difference relating to this protocol. The Node Propagation Protocol (NPP) only needs to receive any message so that it may update its surrounding node list.

Surrounding Node Lists

Each train warning device 26 may maintain a limited (application dependent, but a minimum of two is preferred) list of surrounding warning devices 26 (i.e., "nodes"), their received signal strength indicator (RSSI) values, and timestamp (either absolute, relative, or something that can be used to measure elapsed time accurately). When a train warning device 26 receives any message, regardless of intended recipient, the train warning device 26 will use the information in the message to update its surrounding node list. The surrounding node list may be ordered from highest RSSI value to lowest. For example, an RSSI value of −150 is considered lower than an RSSI value of −130. Train warning devices 26 that exceed the lowest RSSI value in the surrounding node list may not be recorded. Train warning devices 26 that are inserted into the surrounding node list may remove the lowest train warning device 26 in the surrounding node list if the lowest train warning device 26 now exceeds the surrounding node list limit. Train warning devices 26 that already exist in the surrounding node list will have their ranking updated (list reordered). Train warning devices 26 that have not been updated after a known amount of time shall be considered "gone" and removed from the surrounding node list. The pruning time shall be based on the status message transmission interval, and the time shall not exceed the message transmission interval multiplied by 3. For example, if the interval time is set to 30 seconds, then train warning devices 26 will timeout of the list after 90 seconds of no received messages.

Figure 4:
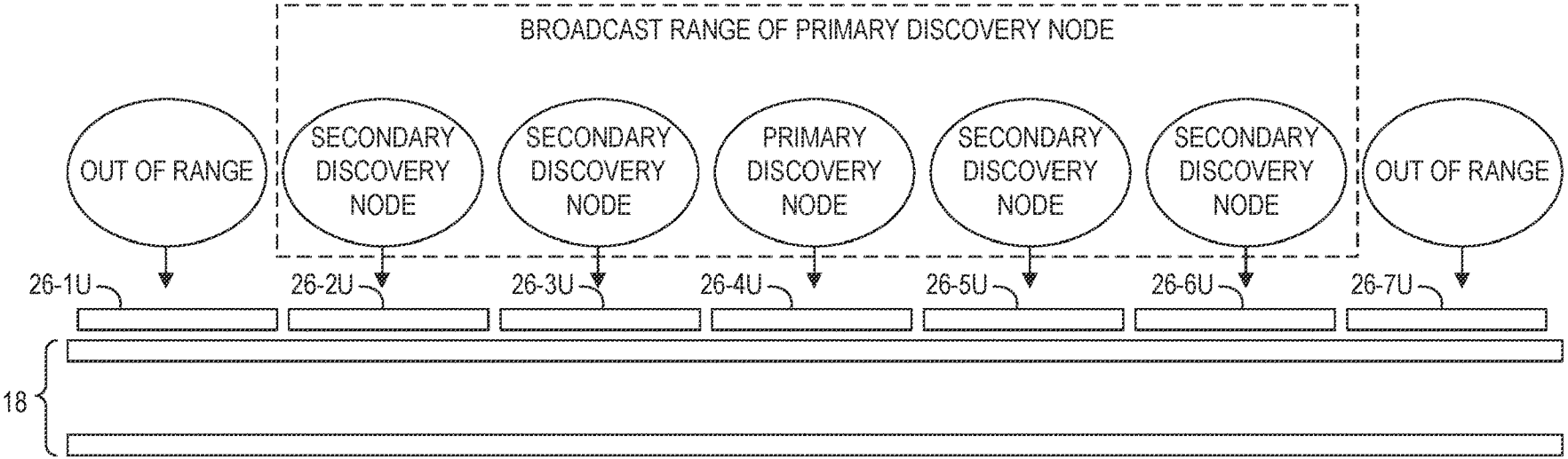
FIG. 4 is a schematic diagram illustrating a discovery mechanism among a plurality of warning devices coupled along a length of a railroad track illustrated according to one embodiment.

FIG. 4 is a schematic diagram illustrating a discovery mechanism among a plurality of warning devices 26 coupled along a length of a railroad track illustrated according to one embodiment.

Neighbor Discovery

For Node Propagation Protocol (NPP) to propagate messages properly, each train warning device 26 discovers and keeps track of its neighbor train warning devices 26. A neighbor is a train warning device 26 that is directly next to the train warning device 26. If another train warning device 26 is between two train warning devices 26 that are negotiating whether they are neighbors, those two train warning device 26 cannot be neighbors. A train warning device 26 can only have 2 neighbors but may have no neighbors (no other train warning device 26 in the domain), or just one neighbor (last train warning device 26 in the line).

For resilient propagation to operate properly, it is desirable that the train warning devices 26 are not in a continual discovery mode, potentially rearranging themselves. In some embodiments, this may be avoided by having the neighbor discovery process initiated in response to some controllable event, such as in response to an action initiated by an operator. By way of non-limiting example, a train warning device 26 may determine that it should enter the primary discovery mode in response to a magnetic switch, a physical switch, a button, a wireless message, a universal serial bus (USB) command, or any other desirable input mechanism.

When a train warning device 26 determines that the train warning device 26 should enter the primary discovery mode, the train warning device 26 may periodically broadcast a discovery message to surrounding train warning devices 26. The discovery message may contain two fields in the payload:

1) Primary train warning device 26 identifier (ID): the ID of the primary train warning device 26. Only the primary train warning device 26 shall set this value, and all secondary train warning devices 26 must copy this value.
2) Surrounding train warning device 26 list: the surrounding train warning device 26 list that the primary train warning device 26 has been maintaining. Each train warning device 26 will use their own list when broadcasting the discovery message.

The discovery message shall not propagate. So the hop next value is empty, and the hop count shall be set to 0 so that all train warning devices 26 within reception range may process the discovery message but not propagate the discovery message. This discovery message shall be transmitted by the primary discovery train warning device 26 at a known interval until primary discovery mode is ended. Primary discovery mode may end via a timeout or via input from the operator.

When a train warning device 26 receives the discovery message from a primary discovery train warning device 26 (and only from the primary discovery train warning device 26), the train warning device 26 shall go into secondary discovery mode. Determination of whether a discovery message is from a primary or secondary train warning device 26 is based on the source value in the header and the primary train warning device 26 ID in the payload of the discovery message. If the source and primary train warning device 26 IDs match, the discovery message is from the primary discovery train warning device 26; otherwise, the discovery message is from a secondary discovery train warning device 26. While a train warning device 26 is in secondary discovery mode, the train warning device 26 will periodically broadcast a discovery message, configured for no propagation. The primary train warning device 26 ID shall be set to the originating primary train warning device 26, not the secondary train warning device 26. This will prevent train warning devices 26 within reception range of the secondary train warning device 26 from entering discovery mode when they are not intended to. Those train warning devices 26 will receive the discovery message from the secondary train warning device 26, but when examining the source and primary train warning device 26 ID, they will determine it is not a primary train warning device 26 that is broadcasting the discovery message, and may therefore ignore the discovery message. Secondary train warning devices 26 may initiate a timer, and when this timer reaches a determined time, the secondary train warning device 26 will timeout the discovery process and move out of secondary discovery mode. Each time a primary discovery message is received from the primary discovery train warning device 26, a secondary discovery train warning device 26 shall reset or extend the timer. This results in a system that is self-correcting in case some unknown condition occurs to stop the primary discovery train warning device 26 from continued broadcast.

While train warning devices 26 are in secondary or primary discovery mode, they continuously update the identity of their neighbor train warning devices 26 based on the highest two ranking RSSI values in their surrounding train warning device 26 list. As an example, consider surrounding_train warning device 26_list[0] as the closest (or highest RSSI value) and surrounding_train warning device 26_list [1] as the second closest (or second highest RSSI value). For middle train warning devices 26 (train warning devices 26 that are not at the end of a chain of train warning devices 26), neighbor A can be surrounding_train warning device 26_list [0] and neighbor B can be surrounding_train warning device 26_list[1]. It does not matter if they are assigned A or B or swapped. However, this does not work for terminating train warning devices 26 since the two highest RSSI values will be from a neighbor train warning device 26 and from another train warning device 26 that is not a neighbor train warning device 26. Since the train warning devices 26 may have no knowledge if they are a terminating train warning device 26 or not, all train warning devices 26 must look at neighbor information to determine if the neighbor train warning device 26 is closer to one of the 2 highest surrounding train warning devices 26 than the terminating train warning device 26 is. If the neighbor train warning device 26 is closer to the second RSSI value, then that means that a train warning device 26 cannot be a neighbor train warning device 26 and that the train warning device 26 is a terminating train warning device 26. A train warning device 26 is considered a terminating train warning device 26 when it cannot resolve a second neighbor train warning device 26 whether it be because there are only 2 train warning devices 26 in the chain, or because the train warning device 26 has determined that a neighbor train warning device 26 is closer to the second train warning device 26 in its surrounding train warning device 26 list. This means that the train warning device 26 should keep track of the 2 highest surrounding train warning devices 26 and also keep track of those surrounding train warning device 26 lists as well to reference when determining if it is a termination train warning devices 26 or not. A simple algorithm can be derived from this rule set as follows using pseudo code:

```
IF surrounding_train warning device 26_list[0].list[ surrounding_train
warning device 26_list[1].ID ].rssi > surrounding_train warning device
26_list[1].rssi THEN
  this train warning device 26 is not a neighbor since
  surrounding_train warning device 26_list[0] is closer to it
ELSE
  this train warning device 26 is a neighbor
ENDIF
IF surrounding_train warning device 26_list[1].list[ surrounding_train
warning device 26_list[0].ID ].rssi > surrounding_train warning device
26_list[0].rssi THEN
  this train warning device 26 is not a neighbor since
  surrounding_train warning device 26_list[1] is closer to it
ELSE
  this train warning device 26 is a neighbor
ENDIF
```

While in secondary and primary discovery mode, the primary discovery train warning device 26 and the train warning devices 26 that have resolved themselves as neighbors to the primary discovery train warning device 26 may provide an indicator that they are all neighbors. Example indications comprise a predetermined light pattern, or predetermined color, or predetermined flashing LED sequence. This may help an operator ensure that proper neighbor resolution has occurred.

Figure 5:
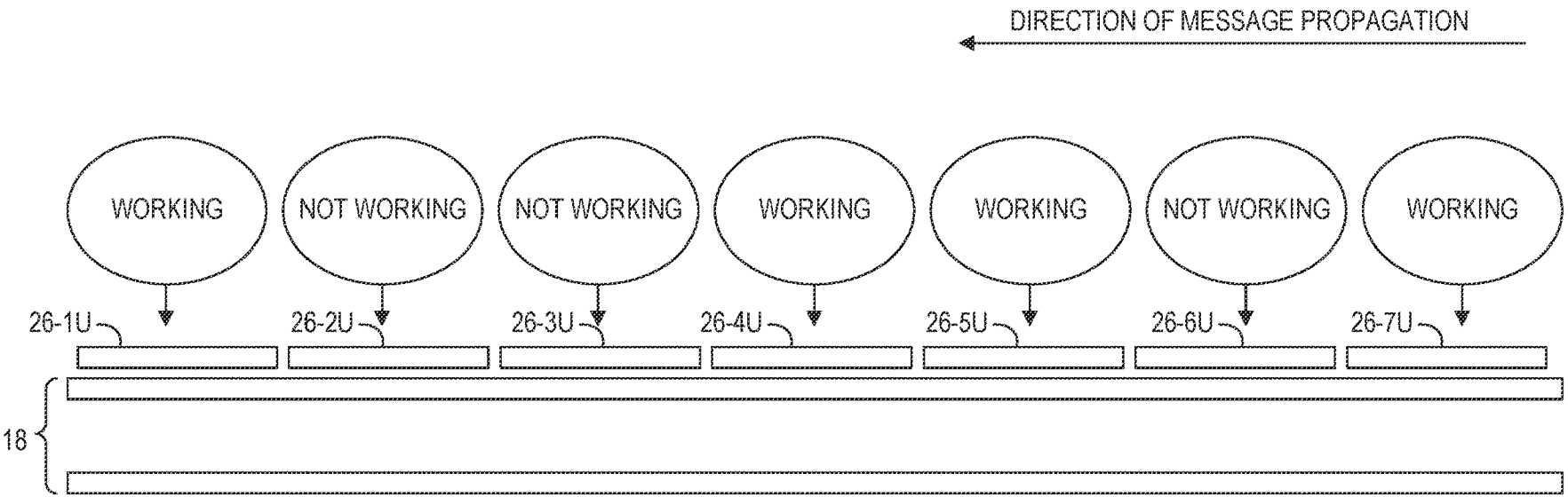
FIG. 5 is a schematic diagram illustrating a resilient propagation mechanism among a plurality of warning devices coupled along a length of a railroad track illustrated according to one embodiment.

FIG. 5 is a schematic diagram illustrating a resilient propagation mechanism among a plurality of train warning devices 26 coupled along a length of a railroad track illustrated according to one embodiment.

Resilient Propagation

In some embodiments train warning devices 26 may implement a self-healing mechanism to facilitate message propagation even in the event that one or more train warning devices 26 fail. Propagation may be self-healing where only one consecutive train warning device 26 has failed. Where two consecutive train warning devices 26 have failed, the system may stop propagating.

As an example, FIG. 5 illustrates a plurality of train warning devices 26-1U-26-7U. The train warning devices 26-1U, 26-4U, 26-5U and 26-7U are operable, and the train warning devices 26-2U, 26-3U, and 26-6U are inoperable. Assume, for purposes of illustration, that the train warning device 26-7U sends a message to the train warning device 26-6U for propagation. The train warning device 26-5U is within reception range of the train warning device 26-7U, so the train warning device 26-5U receives the message destined for the train warning device 26-6U but the train warning device 26-5U does not process the message because the message is not destined for the train warning device 26-5U. The train warning device 26-5U determines that the message meets requirements for continued propagation by the train warning device 26-6U, but determines that no message has been received from the train warning device 26-6U after a predetermined timeframe such as, by way of non-limiting example, 200 ms.

The train warning device 26-5U takes authority over the message to continue propagation. Because the hop count in the message did not get decremented by the inoperable train warning device 26-6U, the train warning device 26-5U decrements the hop count by a value of two instead of one, and then continues propagation as normal. Thus, the hop count remains accurate even though the train warning device 26-6U never processed the message.

A train warning device 26 attempting to heal propagation due to an inoperable neighbor train warning device 26 should determine if the message would have propagated past the inoperable neighbor train warning device 26. For example, assume that the train warning device 26-4U sends a message to the train warning device 26-3U for propagation that should not be propagated past the train warning device 26-2U. The train warning devices 26-3U and 26-2U are inoperable. The train warning device 26-1U receives the message, but determines that the message has a destination address for the inoperable train warning device 26-2U, and thus the train warning device 26-1U should not take authority as the message would have stopped at the inoperable train warning device 26-2U. Similarly, if the hop count of the message would have reached zero at either of the inoperable train warning devices 26-3U and 26-2U, the train warning device 26-1U should also not take authority and continue propagating the message as the message would have stopped propagating prior to reaching the train warning device 26-1U.

Preferably, train warning devices 26 are installed within a reception range such that at least 4 other train warning devices 26 may receive messages from an originating train warning device 26: two train warning devices 26 in one direction, and two train warning devices 26 in the other. The healing process may not work if there are not at least two train warning devices 26 in range in both directions.

Preferably there are two domains (e.g., chains of train warning devices 26) for each track run (e.g., a continuous run of track which may be is ended by a train station or a track switch). Domain A will be on one side of the railroad track, and domain B will be on the opposite side. Which assignment does not matter, however it should remain consistent for the entirety of the track run.

Domains may be user configurable and may be determined during a design phase of the project. This will allow domains to be set and operate separately even if multiple railroad tracks are adjacent to one another other. All train warning devices 26 may contain domain information for the domain to which they belong and domain information for the train warning devices 26 in the other domain on the opposite side of the railroad track.

In some embodiments, when a pedestrian is detected by a train warning device 26, the train warning devices 26 may illuminate its lights with a color/pattern based on the state of the node and the train location and include a strobing or flashing warning simultaneously with the color indication. When no pedestrian is nearby the lights may not strobe or flash to save on power.

Assuming a pedestrian is activating every node, the nodes behavior will be the following. When a train is detected at a train warning device 26, the train warning device 26 may illuminate a specified color. When a train is no longer being detected at the train warning device 26 (i.e., the train has finished passing by), the train warning device 26 may remain a specified color for a predetermined period of time, configured by the user or via automation. Once the predetermined period of time has elapsed, the train warning device 26 may illuminate a specified color again. For train warning devices 26 ahead of the train (i.e., in the direction the train is headed), X number of train warning devices 26 ahead of the train may illuminate a specified color. After X number of train warning devices 26, Y number of train warning devices 26 may illuminate a specified color. Any number of train warning devices 26 after Y, may be a specified color. X and Y values may be configurable and set per application which may include static configuration or dynamic configuration which may use train speed to determine how many train warning devices 26 should be used for X and Y values. Nodes will be programmed so that they can work as an independent system or can be controlled from outside services.

Figure 6:
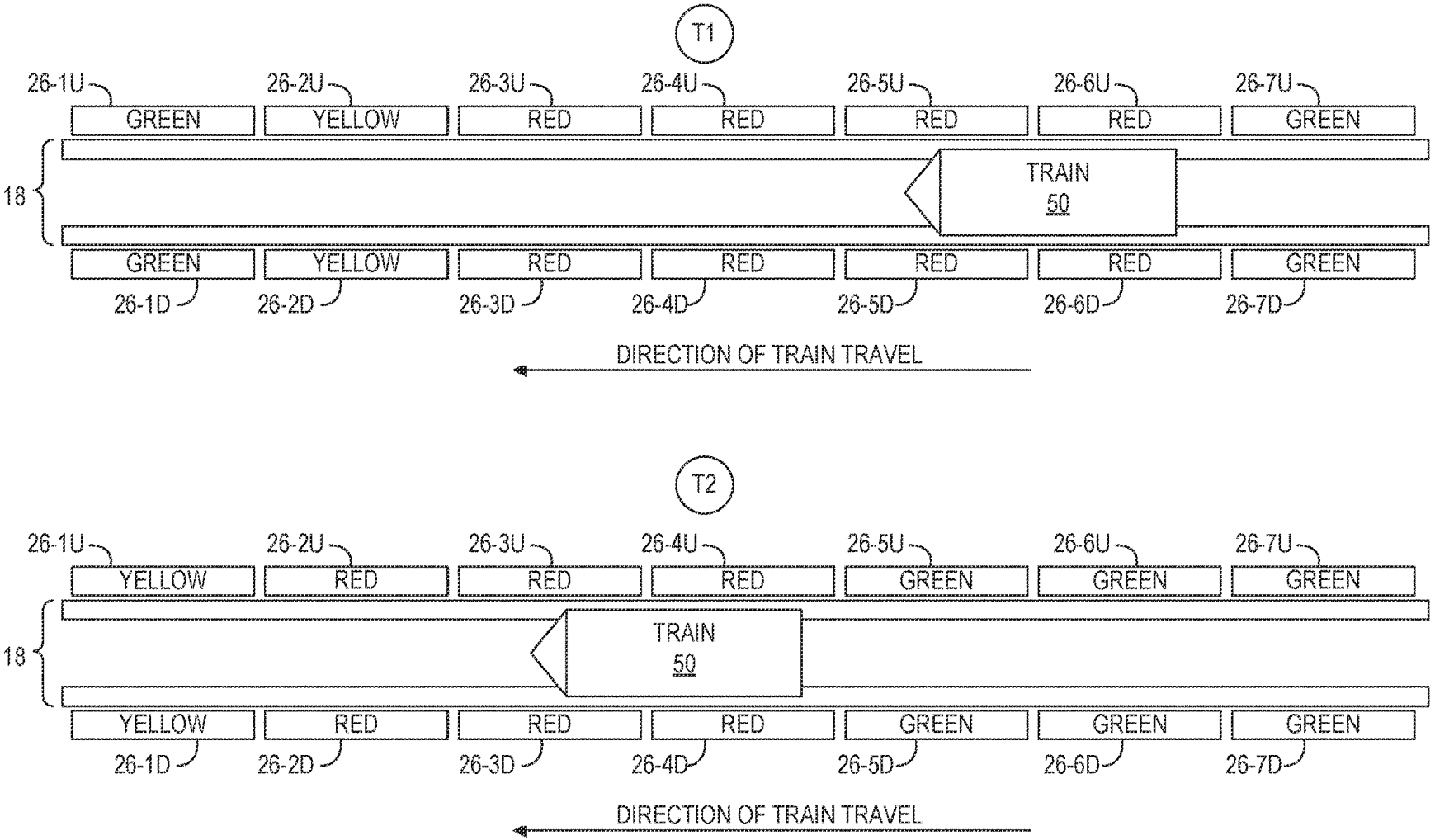
FIG. 6 is a schematic diagram illustrating an example emission of colors from train warning devices coupled to a railroad track according to one embodiment.

FIG. 6 is a schematic diagram illustrating an example emission of colors from train warning devices 26 coupled to a railroad track at two instances in time according to one embodiment. In this example, at a time T1, a train 50 has just passed by train warning devices 26-7U and 26-7D, and the train warning devices 26-7U and 26-7D determine that no additional oncoming train is known to be coming. The train state 48 is thus set to an idle state, and the train warning devices 26-7U and 26-7D cause a predetermined color, in this example, green, to be emitted by the corresponding light assemblies 30.

The train warning devices 26-3U-26-6U, and 26-3D—26-6D, determine that the train 50 is either passing over the train warning devices 26-3U 26-6U, and 26-3D-26-6D, or will be within a predetermined time, and/or is within a predetermined distance away, and thus set the train state 48 to an occupied state and cause the corresponding light assemblies 30 to emit a predetermined color, in this example red. Upon passing by each of the train warning devices 26-3U-26-6U, and 26-3D—26-6D, each of the train warning devices 26-3U-26-6U, and 26-3D—26-6D will determine that the train state 48 is the idle state, and will cause the corresponding light assemblies 30 to emit a green color.

The train warning devices 26-2U and 26-2D, which may be, for example, thousands of feet from the train 50, determine that the oncoming train 50 that is at least a predetermined distance and/or an amount of time from their respective locations, and thus determine the train state 48 to be the leading state. The train warning devices 26-2U and 26-2D cause the corresponding light assemblies 30 to emit a yellow color.

The train warning devices 26-1U and 26-1D, determine that the oncoming train 50 is at least a first predetermined distance and/or a first amount of time from their respective locations, and thus determine the train state 48 to be the idle state. The train warning devices 26-1U and 26-1D cause the corresponding light assemblies 30 to emit a green color.

At a time T2, the train 50 has passed the train warning devices 26-5U-26-6U and 26-5D—26-6D, and thus the train warning devices 26-5U-26-6U and 26-5D—26-6D now emit a green color. The train warning devices 26-2U-26-2D determine that the oncoming train 50 will arrive within a predetermined time, and/or is within a predetermined distance away, and thus set the train state 48 to an occupied state and cause the corresponding light assemblies 30 to emit a red color. The train warning devices 26-1U-26-1D determine that the oncoming train 50 is at least a predetermined distance and/or an amount of time from their respective locations, and thus determine the train state 48 to be the leading state, and cause the corresponding light assemblies 30 to emit a yellow color.

Roles

In some embodiments, a train warning device 26 may assume one of three possible roles that are resolved after discovery has been performed:

- Solo: The train warning device 26 has not resolved any neighbor train warning devices 26 at all. This is the default state the train warning device 26 comes from the factory.
- Terminating: The train warning device 26 is at one of the ends of a chain of train warning devices 26. These train warning devices 26 may only have one neighbor train warning device 26 and are aware that they will only have one neighbor train warning device 26, which will be used in the train direction resolution algorithm.
- Middle: The train warning device 26 is in the middle of a chain of train warning device 26. These train warning devices 26 will have two neighbor train warning devices 26 which will be used in the train direction resolution algorithm.

States

In some embodiments the train warning device 26 will be in one of six possible states that may be reflected in the corresponding train state 48:

- Idle state: The train warning device 26 does not sense a train nearby and does not anticipate one anytime soon. This may be the default state of all train warning devices 26. Most of the train warning devices 26 life may be in this state. While in this state the light assembly 30 may emit a specified color, such as green;
- Occupied state: The train warning device 26 senses a train on top of the train warning device 26 and the train warning device 26 knows which direction the train is traveling. While in this state the light assembly 30 may emit a specified color, such as a red color. The train warning device 26 may remain in this state until the train has passed (is no longer detected) then the train warning device 26 may move to the departing state (discussed below). Train warning devices 26 in this state may send out status packets at a more frequent interval;
- Occupied Pending state: The train warning device 26 senses a train on top of it, but it does not know what direction the train is traveling. While in this state the light assembly 30 may show a specified color, such as red. The train warning device 26 may remain in this state until the train has passed is (no longer detected) or until the train warning device 26 can resolve travel direction in which the train warning device 26 will move to the occupied state. If the train warning device 26 is no longer occupied, the train warning device 26 will move to the departing state. The train warning devices 26 in this state may send out status packets at a more frequent interval.
- Departing state: This is the final state before the train warning device 26 returns to the idle state. Typically, this state occurs after a train passes by (the train warning device 26 was in an occupied state, but is no longer in the occupied state). The train warning device 26 may remain a specified color for T amount of time. After the T amount of time elapses, the train warning device 26 may return to the idle state. Train warning devices 26 in this state will send out status packets at a more frequent interval.
- Leading state: The train warning device 26 does not detect a train; however, the train warning device 26 received a train notification message that there is an oncoming train headed toward the train warning device 26. The light assembly 30 will be based on how far away the train is. In some embodiments, the train warning devices 26 may base the color on the distance of the train from the location of the train warning devices 26 (which may be determined based on the number of hops away the train is), and on the speed of the train. Thus, a train that is X hops from the train warning device 26 may be one color, and a train that is Y hops from the train warning device 26 may be a different color. In some embodiments, if none of the neighbor train warning devices 26 are in a leading state or occupied state, the train warning device 26 will move to a departing state. If none of the neighbor train warning devices 26 are in leading or occupied states, the train warning device 26 will move to the departing state. If the train warning device 26 senses a train, it will move into the occupied state. Train warning devices 26 in this state will send out status packets at a more frequent interval.

Lead Pending state: One of the neighbor train warning devices 26 is in an occupied pending state which means the neighbor train warning device 26 does not know which way the train is traveling. Until the neighbor train warning device 26 resolves direction, or this train warning device 26 moves to an occupied state, this train warning device 26 will assume the train has a possibility to occupy it next. When the neighboring train warning device 26 resolves travel direction, and it was not in the direction of this train warning device 26, it will move to the departing state.

When a train warning device 26 changes states, the train warning device 26 sends out a status packet to inform neighbor train warning devices 26 of the state change immediately so that the neighbor train warning devices 26 may handle any reactional logic.

Each train warning device 26 may keep track of states for four different train warning devices 26: its own, its synchronization train warning device 26 (as discussed in greater detail below), and two neighbor train warning devices 26.

Figure 7:
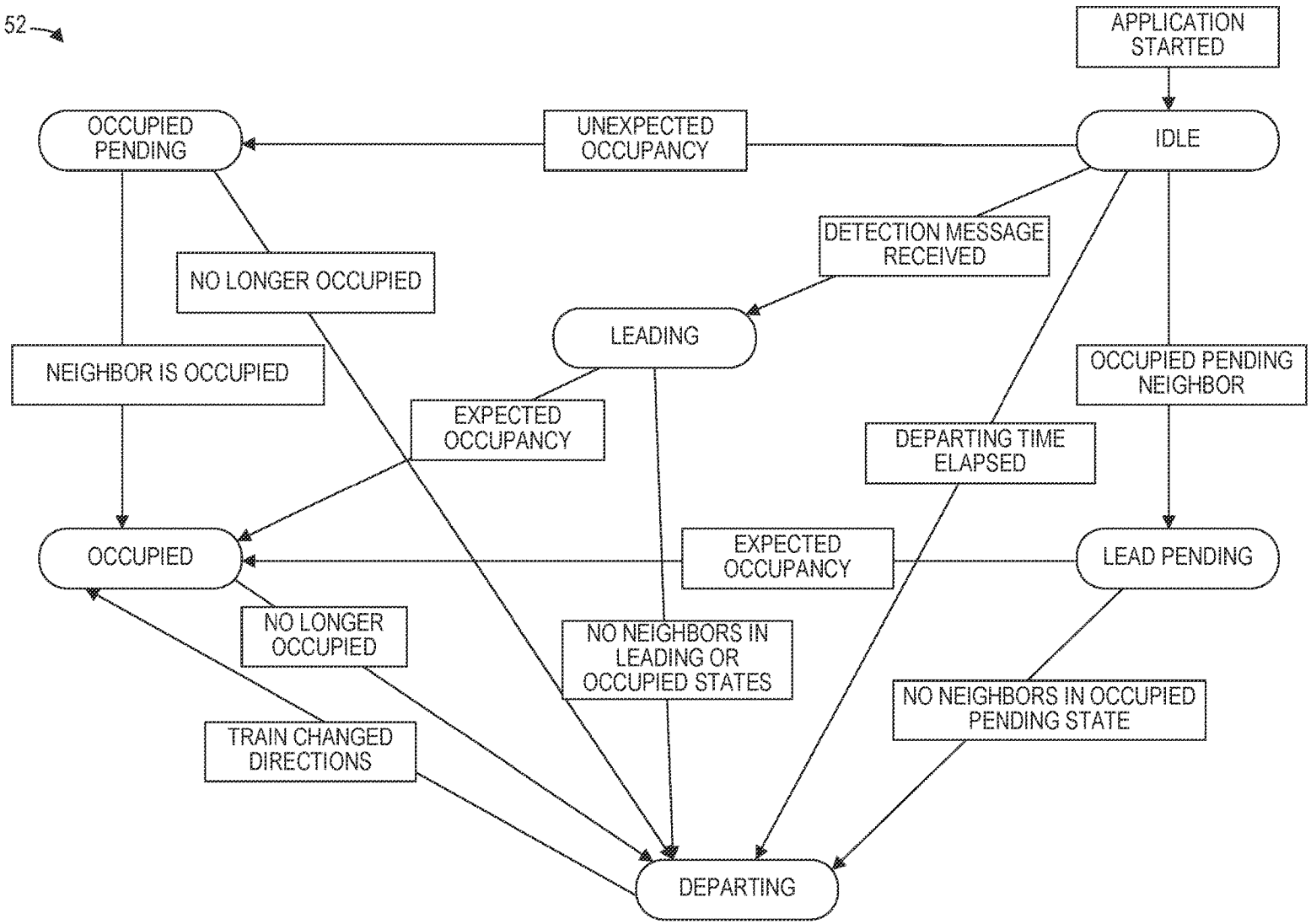
FIG. 7 is a state and transition diagram that illustrates the states discussed above, and transitions between such states.

FIG. 7 is a state and transition diagram 52 that illustrates the states discussed above, and transitions between such states.

Status Messages

Train warning devices 26 may let their neighbor train warning devices 26 know what state they are in via the status messages. Status messages may be transmitted at a configured interval. Status messages may also be transmitted when the state of a train warning device 26 changes. A timer may be reset each time a status message is sent, and a train warning device 26 may send a status message when the timer elapses or when changing state. Train warning devices 26 may keep track of the state of each of its neighbor train warning devices 26 and the synchronization train warning device 26, including whether the neighbor train warning devices 26 are operable or inoperable. If a train warning device 26 does not receive a status update within T time (calculated, for example, by status_interval_time*3) from a neighbor train warning device 26, then the train warning device 26 may mark that neighbor train warning device 26 as inoperable. Status messages may be configured so they do not propagate by setting the hop count to 0 and the hop next value to empty so that all train warning devices 26 may process the message.

Train warning device 26 status messages may contain the current state of the train warning device 26, the state of its neighbor train warning devices 26, and the state of its synchronization train warning device 26, health information of the transmitting train warning device 26, and the ID of the train warning device 26 that originated the message.

Train warning device 26 status messages provide information to neighbor train warning devices 26 with state information which may be used to alter their behavior, such as the color of light of the light assembly, as the states change.

Train Notification Message and Propagation

When a train is detected at a train warning device 26, and that train warning device 26 can resolve travel direction, the train warning device 26 may send out a train notification message for propagation in the direction in which the train is traveling so that leading (downstream) train warning devices 26 can be notified of the train. This message may propagate down the line of train warning devices 26 until the hop count reaches 0. As idle/leading train warning devices 26 receive the train notification message through propagation, they may update states and determine what color they cause to be emitted from the corresponding light assembly 30. The color that train warning devices 26 determine may be based on the hop count of the message as they receive it from propagating down the line. The message originating train warning device 26 may configure the message so there are enough hops for each color: X hops for color 1 leading train warning devices 26, and Y hops for color 2 leading train warning devices 26 for a total of X+Y hops. The train warning device 26 shall continue to transmit this message at a set interval while it remains in the occupied state. The X and Y hop values may be configured statically or dynamically based on additional information such as train speed.

As train warning devices 26 that are in leading or idle states receive the train notification message, such train warning devices 26 decrement the hop count before transmitting to the next train warning device 26. If the train warning device 26 is in the idle state, the train warning device 26 may move to the leading state. Based on the hop count when the train notification message was received, the train warning device 26 shall determine what color should be emitted from the light assembly 30. When a train warning device 26 in the leading or idle state receives the detection message with a hop count of 0, the train warning device 26 may cause the light assembly 30 to emit a particular color and stop propagation. A minimum hop count of 1 may be required to be transmitted by the occupied train warning device 26 for this kind of detection message. This may allow the message to propagate and cause at least one leading train warning device 26 to turn a specified color and one leading train warning device 26 to turn a specified color.

If an occupied train warning device 26 is preparing to send a train notification message, the train warning device 26 may check that the neighbor train warning device 26 to which the train notification message will be propagated is not already in an occupied state. If the neighbor train warning device 26 is already in the occupied state, the train warning device 26 may not send the train notification message. If the neighbor train warning device 26 is not in the occupied state, the train warning device 26 may send the train notification message.

If a neighbor train warning device 26 does receive a train notification message and the neighbor train warning device 26 is already in an occupied state, the neighbor train warning device 26 may ignore the message.

Direction Resolution

Train warning devices 26 may keep track of a value such as a train_origin value, which may contain an ID of which neighboring train warning device 26 a train is likely to come from or a previous train did come from. When the train warning device 26 moves into an occupied state, the train warning device 26 may use this value to determine travel direction. This value may be empty initially and may be updated based on information the train warning device 26 receives from its neighbor train warning devices 26.

If an idle train warning device 26 detects a train, it may assume it was an unexpected detection because it doesn't know what direction the train originated from, regardless of what value train_origin has. This may be common on terminating train warning devices 26 (train warning devices 26 at each end of the chain). The train warning device 26 must then attempt to resolve what the train_origin value should be by looking at the states of neighbor train warning devices 26, algorithms such as the following may be used depending on the role of the train warning device 26:

1) solo train warning devices 26: No direction may be resolved with such train warning devices 26;
2) terminating train warning devices 26: These may look at their one neighbor train warning device 26, if the neighbor train warning device 26 is occupied the train warning device 26 may set train_origin to the neighbor train warning device 26 and do nothing from there since it is the end of the line. If the neighbor train warning device 26 is not occupied, the train warning device 26 may assume the train is travelling towards the single neighboring train warning device 26, and the train warning device 26 can move into an occupied state and send a train notification message propagating in that direction;
3) middle train warning devices 26: If only one neighbor train warning device 26 is occupied or occupied pending, the train warning device 26 may set train_origin to the value of that neighbor train warning device 26, move into an occupied state, and generate a train notification message for propagation. If both neighbor train warning devices 26 are occupied, or no neighbor train warning devices 26 are occupied, the neighbor train warning device 26 may set train_origin to empty, move into occupied pending state, and assume it does not know travel direction. Neighbor train warning devices 26 of that train warning device 26 may then receive the state change to the occupied pending state and move themselves into the lead pending state. Those neighbor train warning devices 26 may also assign their train_origin value to the occupied pending train warning device 26 ID, since the train may be coming from that direction. When the train moves forward, and triggers the next train warning device 26, that train warning device 26 may know where the message came from and the train warning device 26 may update its state to occupied and generate a train notification message for propagation. The occupied pending train warning device 26 may receive its neighbor train warning devices 26 state update and update itself to the occupied state and set the train_origin value appropriately. The remaining lead pending train warning device 26 may receive a state update from the occupied pending train warning device 26 and see that occupied pending train warning device 26 has moved to the occupied state, thus train warning device 26 may set itself in the departing state since the train is not moving in its direction.

When a train warning device 26 in a leading state or idle state receives a train notification message, the train warning device 26 may set its train_origin value to the hop source ID in the message since it is reasonable to assume the train may come from the direction of the train warning device 26 that sent the train notification message. When the leading train warning device 26 moves into an occupied state, the leading train warning device 26 may now use the train_origin value to determine how it shall configure its detection message for propagation and resolve travel direction.

Changing Directions

If a train changes direction in the middle of a track, the system may adapt to the change once the train triggers its first train warning device 26 in the new travel direction.

The first leading train warning device 26 next to the occupied train warning device 26 may see the occupied train warning device 26 change its state. This may signal to that leading train warning device 26 that the train changed directions, so the train warning device 26 may move into a departing state as well. Other leading train warning devices 26 may see that their neighboring leading train warning devices 26 changed state to departing state, and may also change to departing state. This may clear the leading train warning device 26 states for all train warning devices 26 in the original traveling direction. These train warning devices 26 may eventually move back to an idle state.

From here, the newest occupied train warning device 26 may be in either departing state or an idle state. Since the train warning device 26 was not expecting a train detection, the train warning device 26 may look at its neighbor train warning devices 26 to determine which way the train came from. This is done by locating the neighbor train warning device 26 that is currently occupied, then flagging that as the train origin. This may then allow the train warning device 26 to send out the train notification message in the new traveling direction. If for some reason the train warning device 26 is unable to determine direction of origin, the train warning device 26 may follow the standard process used for the occupied pending state and may require one more train warning device 26 detections in the new traveling direction to resolve.

Synchronized Train Warning Devices

Since a railroad track may have two linear chains of train warning devices 26 running on different sides of the track, and given the critical nature of the railway safety system, a synchronization system may be implemented that takes advantage of the two sides to help ensure further reliability. This system may let adjacent train warning devices 26 pair up for synchronization. For example, a train warning device 26U on track side A may have a neighbor train warning device 26D directly adjacent on track side B. These two train warning devices 26 may become synchronization train warning devices 26 for this system and mimic each other's states when applicable. An algorithm may be used to determine if a train warning device 26 shall use its own state or its synchronized neighbor's state. For example, if train warning device 26U fails to receive a detection message through normal propagation, whether due to failed train warning devices 26 or failed transmissions, if the synchronized train warning device 26D is still working properly, the train warning device 26D may instruct the train warning device 26U that the state of the train warning device 26D has changed, and the train warning device 26U can mimic the train warning device 26D and synchronize with the state of the train warning device 26D.

Train warning device 26 synchronization selection may occur, for example, while the train warning device 26 is in discovery mode. The selection may be resolved by two metrics: lowest RSSI value, and that the two train warning devices 26 are on opposite train warning device 26 domains. To help ensure that a proper train warning device 26 is selected, if the RSSI value is greater than or equal to one of the discovering train warning devices 26 neighbor RSSI values, that train warning device 26 cannot be synchronized with it. This is to combat a condition in which the train warning device 26 on the other side of the track may be dead and the next closest RSSI value may be a train warning device 26 that was not intended to synchronize with it.

The system may utilize the protocol to transmit messages between synchronized neighbor train warning devices 26, but message configuration may be set with the hop next as the synchronized train warning device 26 and the hop count set to 0 so that others in that domain do not pick the message up and propagate it.

In some embodiments, synchronized train warning devices 26 may process messages from the other domain with train warning devices 26 they have paired with.

In some embodiments, only status messages may be transmitted between synchronized train warning devices 26.

Discovery Mode

In some embodiments, all train warning devices 26 in discovery mode (primary or secondary) shall cease all normal operations and dedicate to only discovery mode operations. Once discovery mode is complete, they may begin operating normally again and cease all discovery operations.

Message Encryption

In some embodiments, all message data may be encrypted using a special algorithm similar to public/private key encryption. Each message may provide a randomized public key that changes for each transmission. The private key may be hard coded in the firmware of the train warning devices 26. Utilizing both keys, train warning devices 26 may decrypt the messages for processing.

Figure 8:
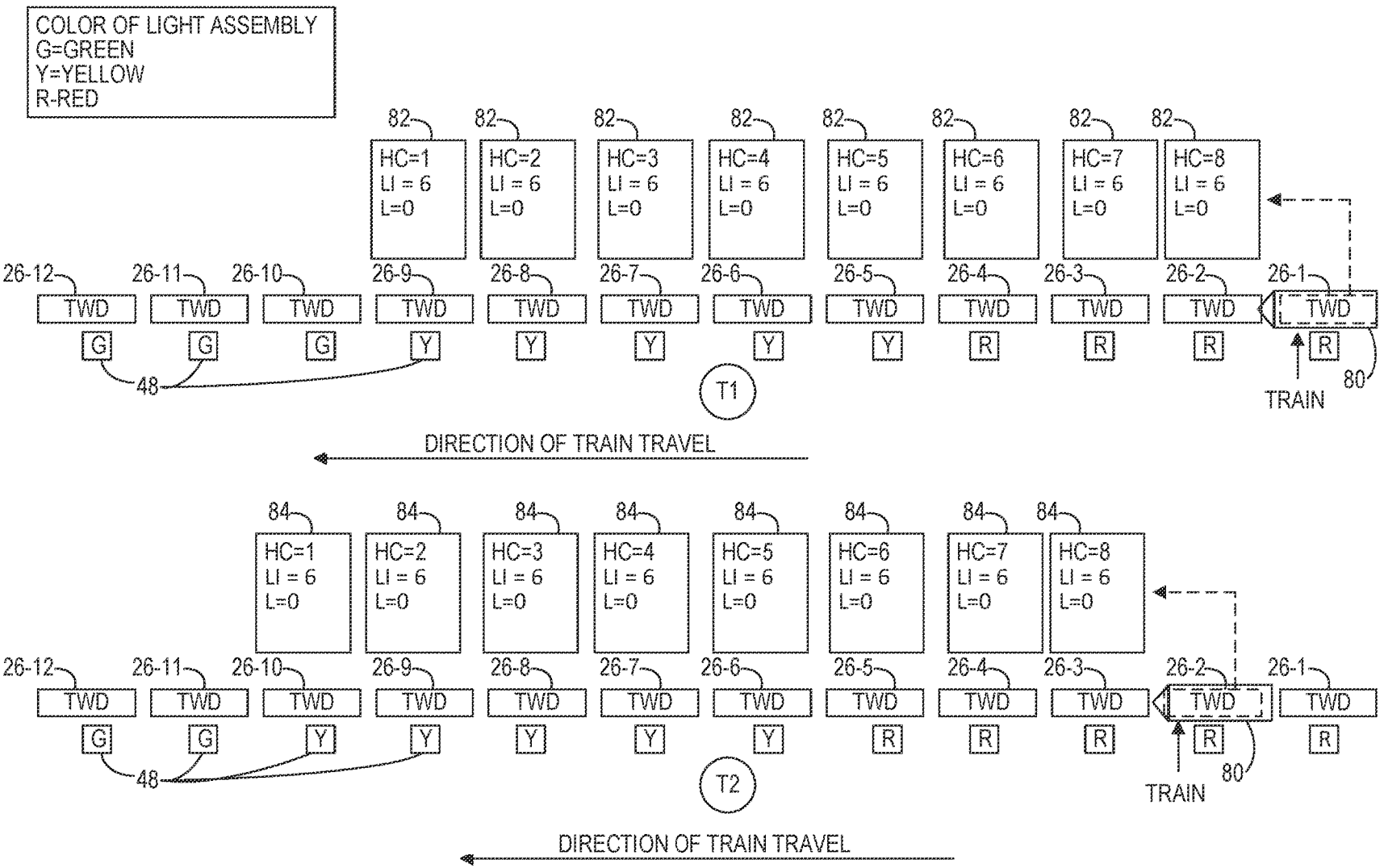
FIG. 8 is a schematic diagram illustrating example message propagation and emission of colors from train warning devices coupled to a railroad track according to another embodiment.

FIG. 8 is a schematic diagram illustrating an example propagation of messages and emission of colors from train warning devices 26 coupled to a railroad track in response to train detection messages according to one embodiment. In this example, at a time T1, a train 80 is passing over a train warning device 26-1. The train warning device 26-1 detects that the train 80 is passing over the train warning device 26-1. The train warning device 26-1 sets the current train state 48 of the train warning device 26-1 to an occupied train state. In this example, the occupied train state corresponds to a color of red, and the train warning device 26-1 causes the corresponding light assembly 30 to emit the color red. The train warning device 26-1 generates a train detection message 82 (sometimes referred to herein as a train detection packet) that identifies a hop count (HC) of 8 in the header of the train detection message. The hop count may be user configurable for each train warning device 26. The train warning device 26-1 inserts into the payload portion of the train detection message 82 information that indicates that a respective train warning device 26 that receives the train detection message 82 when the train detection message 82 has a hop count equal to 6 or above should set the current train state 48 of the respective train warning device 26 to a current train state of Leading Imminent. The train warning device 26-1 inserts into the payload portion of the train detection message 82 information that indicates that a respective train warning device 26 that receives the train detection message 82 when the train detection message 82 has a hop count between 1 and 5 should set the current train state 48 of the respective train warning device 26 to a current train state of Leading.

The train warning device 26-1 sends the train detection message 82 to the downstream train warning device 26-2. The train warning device 26-2 receives the train detection message 82 and determines that the hop count is 8. The train warning device 26-2 determines, based on the payload of the train detection message 82, that a train warning device 26 that receives the train detection message 82 with a hop count between 6 and 8 is to set the current train state 48 of the train warning device 26 to a leading imminent state. The train warning device 26-2 thus, in response to receiving the train detection message 82, sets the current train state 48 of the train warning device 26-2 to the leading imminent state. The train warning device 26-2 is configured to, when the current train state 48 is the leading imminent state, cause the corresponding light assembly 30 to emit the color red.

The train warning device 26-2 decrements the hop counter to 7 and transmits the train detection message 82 to the neighbor train warning device 26-3. The downstream train warning devices 26-3-26-4 repeat this process and each determine that the current train state 48 should be the leading imminent state based on the hop count of the train detection message 82, and cause the corresponding light assemblies 30 to emit the color red.

The train warning device 26-5 receives the train detection message 82 and determines that the hop count is 5. The train warning device 26-5 determines, based on the payload of the train detection message 82, that a train warning device 26 that receives the train detection message 82 with a hop count between 1 and 5 is to set the current train state 48 of the train warning device 26 to a leading state. The train warning device 26-5 thus, in response to receiving the train detection message 82, sets the current train state 48 of the train warning device 26-5 to the leading state. The train warning device 26-5 is configured to, when the current train state 48 is the leading state, cause the corresponding light assembly 30 to emit the color yellow.

The train warning device 26-5 decrements the hop counter to 4 and transmits the train detection message 82 to the neighbor train warning device 26-6 The downstream train warning devices 26-6-26-9 repeat this process and each determine that the current train state 48 should be the leading state based on the hop count of the train detection message 82, and cause the corresponding light assemblies 30 to emit the color yellow.

The train warning device 26-9 decrements the hop counter to a value of zero. Because the value of the hop counter is zero, the train warning device 26-9 does not communicate the message to the train warning device 26-10. The current train states 48 of the train warning devices 26-10-26-12 are an idle state. In this example, the idle state corresponds to the color green, and thus, the train warning devices 26-10-26-12 cause the corresponding light assemblies 30 to emit the color green.

At a time T2, the train warning device 26-2 detects that the train 80 is now passing over the train warning device 26-2. The train warning device 26-2 sets the current train state 48 of the train warning device 26-2 to an occupied train state. The occupied train state corresponds to the color red, and thus the train warning device 26-2 causes the corresponding light assembly 30 to emit the color red. The train warning device 26-1 determines that the train is no longer over the train warning device 26-1, and sets the current train state 48 to a departing state. The departing state corresponds to the color red, and thus the train warning device 26-1 initially causes the corresponding light assembly 30 to emit the color red. The train warning device 26-1 sets a timer to a predetermined amount of time. Upon expiration of the timer, the train warning device 26-1 sets the current train state 48 of the train warning device 26-1 to an idle state. The idle state corresponds to the color green, and thus the train warning device 26-1 causes the corresponding light assemblies 30 to emit the color green.

The train warning device 26-2 generates a train detection message 84 that identifies a hop count (HC) of 8 in the header of the train detection message 84. The train warning device 26-2 inserts into the payload portion of the train detection message 84 information that indicates that a respective train warning device 26 that receives the train detection message 84 when the train detection message 84 has a hop count equal to 6 or above should set the current train state 48 of the respective train warning device 26 to a current train state of Leading Imminent. The train warning device 26-2 inserts into the payload portion of the train detection message 84 information that indicates that a respective train warning device 26 that receives the train detection message 84 when the train detection message 84 has a hop count between 1 and 5 should set the current train state 48 of the respective train warning device 26 to a current train state of Leading.

The train warning devices 26-3-26-12 operate as described above with regard to the discussion regarding the time T1, such that the train warning devices 26-2-26-5 now emit the color red, the train warning devices 26-6-26-10 now emit the color yellow, and the train warning devices 26-11-26-12 now emit the color green. This process repeats as the train 80 continues travelling across the train warning devices 26, causing a certain number of train warning devices 26 in front of the train 80 to emit the color red, another number of train warning devices 26 farther in front of the train 80 to emit the color yellow, and the remainder of the train warning devices 26 to emit the color green.

The following describes another embodiment of the Node Propagation Protocol (NPP).

The NPP is a protocol that propagates data packets (e.g., messages) upstream, downstream, or both between a linear chain of transceivers (train warning devices 26). Unlike most communication protocols, a single data packet can travel (propagate) in two directions concurrently. Packets (e.g., messages) can originate from any position within the chain of train warning devices 26.

Communication System

NPP may sit on top of any communication system that meets two criteria: (1) can broadcast a single packet for multiple devices to receive in a common reception domain, such as Bluetooth® and Enhanced-ShockBurst (ESB); and (2) can provide an absolute, or relative, value which receiving train warning devices 26 can use to compute their relative position (relative position value, RPV) to the train warning device 26 that transmitted the packet, such as Received Signal Strength Indicator (RSSI) in Bluetooth®.

Packet Structure

NPP packets can be encapsulated within lower-level communication system protocols and framing if desired. The term "packet" as used herein is synonymous with the term "message." The NPP payload is preferably extracted from these systems before being processed. If the relative/absolute value needed for relative position computation is within these protocols, that value is preferably extracted and passed on to the NPP packet processor separately.

An NPP packet may consist of the following:

Header—which contains NPP protocol critical information;

Payload—the data being transported for the application.

The header may consist of the following fields, note that the size of these fields is up to the implementing application to define/determine:

Packet Destination: A value containing the identifier of intended recipient(s) of the message. This field supports special/reserved values which indicate special behavior. Only the train warning device 26 first generating the packet shall modify this field.

Packet Source: A value containing the identifier of the first train warning device 26 that generated and transmitted the packet. Only the train warning device 26 first generating the packet shall modify this field.

Hop Count: A value to indicate the number of hops (transmits) the packet has before propagation shall stop. As train warning devices 26 receive and transmit the packet, each train warning device 26 shall decrement this value. Once this value reaches zero, train warning devices 26 shall stop propagating (transmitting) the packet any further.

Hop Source: A value containing the most recent transmitter of the message. Each train warning device 26 may assign their own ID to this value before transmitting.

Hop Destination: A value containing the next train warning device 26 intended to receive the message. This field supports special/reserved values which indicate special behavior. Each transmitting train warning device 26 may determine what this value shall be and assign that value before transmitting.

Packet ID: An ID that indicates what kind of packet it is. There is only 1 reserved ID, the implementing application shall implement any other packet ID the application needs for its own use.

Domain ID: A value unique to the train warning device 26 chain. This is an optional field, determined by the implementing application if the field is needed or not.

Sequence ID: A value containing a sequence ID for reassembling fragmented payloads. This is an optional field, determined by the implementing application if the field is needed or not.

Payload Size: A value containing the size of the payload. This is an optional field, determined by the implementing application if the field is needed or not.

The payload may include whatever data the application is intending to send.

Train Warning Device 26 Identifiers

Each train warning device 26 in the NPP chain is preferably assigned an ID unique within that chain of train warning devices 26. It is possible for train warning devices 26 to have the same ID only if they exist within different train warning device 26 chains. The assignment process is up to the application and not part of the NPP. The format of the ID shall be a number with the size defined by the application implementing the protocol.

Domain Id

Domain ID is a unique ID assigned to a chain of train warning devices 26. Train warning devices 26 shall be assigned to the same domain ID with other train warning devices 26 they intend on communicating with. The format of the ID shall be a number with the size defined by the application implementing the protocol.

This field is optional and should be used in cases where multiple train warning device 26 chains may be communicating in the same transmission domain, for example on the same wireless frequency and channel.

Packet Id

Packet ID shall be used to indicate type of packet and contents of payload may include. There is one ID reserved for NPP, and that ID is the value of 0 which indicates a train warning device 26 neighbor discovery packet. This value shall be a number with the size defined by the application implementing the protocol.

Special Destination Ids

Special destination IDs shall provide a means to indicate special processing behavior for the receiving train warning devices 26. The following IDs are reserved as special destination IDs:

Broadcast—All bits in the destination field shall be set to 1. This indicates that all receiving train warning devices 26 shall process the packet as if the packet was addressed to them.

Neighborcast—All bits in the destination field shall be set to 0. This indicates that only neighbor receiving train warning devices 26 may process the packet as if the packet was addressed to them.

Hop Count

Each train warning device 26 is permitted to modify the value of this field. The first train warning device 26 to generate a packet shall assign this value based on what the train warning device 26 requires to service the message but should place a limit on propagation should the destination not exist. Unless otherwise specified, the initial hop count value shall be determined by the implementing application.

The hop count in the NPP packet header shall determine if a receiving train warning device 26 is permitted to transmit a packet if propagation is required. When a receiving train warning device 26 finds this value set to 0, the train warning device 26 is not permitted to transmit the packet, but the train warning device 26 can process the received packet if processable.

Before a train warning device 26 transmits a packet for further propagation, the train warning device 26 preferably decrements this hop count value. A value of 0 is a valid hop count to transmit ONLY if the received packet hop count was not originally 0 or the packet is intended to no longer be propagated.

Packet Reception and Processing

All train warning devices 26 shall receive packets that may, or may not, be addressed to them. Train warning devices 26 shall inspect the packet header fields to determine if they shall process the packet further. The following conditional check shall be used to determine if the packet shall be processed by the train warning device 26:

1. If implemented, check that Domain ID field matches train warning devices 26 assigned domain ID; and
2. Destination ID is the ID of the train warning device 26; or
3. Hop Destination ID is the ID of the train warning device 26; or
4. Hop Destination ID is broadcast ID; or
5. Hop Destination ID is neighborcast ID and Hop Source ID is one of the train warning devices 26's neighbors;
6. If conditions match, the train warning device 26 shall process the packet; otherwise, the train warning device 26 may ignore the packet.

Train Warning Device 26 Neighbors

Each train warning device 26 can have up to two (2) neighbors. Neighbors are considered the two (2) physically closest train warning devices 26 to a middle train warning device 26, with no train warning devices 26 in between them. Neighbors are determined during a process called neighbor discovery.

Each train warning device 26 may maintain a list of its two (2) neighbors in which each entry just contains the train warning device 26 ID of the neighbor. This list, or a means to restore the list, shall utilize non-volatile memory so the list shall survive power loss and restart events removing the need to execute neighbor discovery again. The implementing application may have the option of erasing the neighbor list if the application desires.

Terminating and Middle Train Warning Devices 26

Terminating train warning devices 26 are the last train warning devices 26 of a linear chain of train warning devices 26, from either end. A terminating train warning device 26 may have no more than one (1) neighbor but can have none. Each chain of train warning devices 26 may have at least 2 terminating train warning devices 26 or no terminating train warning devices 26. A train warning device 26 chain consisting of only one (1) train warning device 26 shall be considered both terminating train warning devices 26. Middle train warning devices 26 always have 2 neighbors.

Train Warning Device 26 Neighbor Discovery

Neighbor discovery is the process of letting a section of train warning devices 26, in a train warning device 26 chain, automatically determine who their neighbors are by using a learning process.

To begin populating the train warning device 26 discovery list, the implementing application shall initiate neighbor discovery mode when the application desires. Initiation shall be executed by directing a specific train warning device 26 to switch to neighbor discovery mode. This train warning device 26 may be known as the primary neighbor discovery train warning device 26 (PNDN). The train warning device 26 shall operate in this mode until the application turns neighbor train warning device 26 discovery off, either manually or automatically. All other train warning devices 26 in the discovery process shall be known as secondary neighbor discovery train warning devices 26 (SNDNs).

While in this mode, each train warning device 26 shall maintain a train warning device 26 discovery list. Each entry in the list shall contain the train warning device 26 ID, the computed RPV, and a list of train warning devices 26 discovered by that train warning device 26 and its RPV values. This list shall start empty each time discovery mode is enabled. It may support at least two (2) train warning devices 26 in the list.

Primary Neighbor Discovery Train Warning Device 26 (PNDN)

While the PNDN is in discovery mode, the PNDN shall consistently broadcast a neighbor discovery packet at an interval set by the implementing application. The header of the NPP packet shall contain the following field values:

Packet Destination ID: Broadcast ID;
Packet Source ID: PNDN ID;
Hop Count: 0;
Hop Source ID: PNDN ID;
Hop Destination ID: Broadcast ID;
Packet ID: 0;
Sequence ID: 0, if implemented;
Domain ID+Payload Size if implemented.

The payload of the of the packet shall contain two fields:

Interval rate: a value indicating how frequent the discovery packet may be broadcast. This value shall be a number with the size defined by the implementing application. The frequency unit (seconds, milliseconds) shall also be determined by the implementing application but is preferably the same between all train warning devices 26 in the chain.

Train warning device 26 List: A list of the 2 lowest RPVs discovered train warning devices 26 known by the PNDN. Each entry shall include the train warning device 26 ID and RPV assigned by the PNDN.

Secondary Neighbor Discovery Train Warning Devices 26 (SNDN)

Secondary train warning devices 26 may not initially be in discovery mode. When a secondary train warning device 26 receives a neighbor discovery packet from a PNDN, the secondary train warning device 26 shall place itself into neighbor discovery mode and save the train warning device 26 ID of the PNDN, known as the initiating primary neighbor discovery train warning device 26 (IPNDN). It may remain in this mode until an internal countdown timer reaches 0. The timer shall be no less than 3 times the discovery broadcast rate found in the PNDN's payload: interval rate. For example, if the interval rate was every 2 seconds, the minimum timer shall be greater than 6 seconds. Each time the secondary train warning device 26 receives the neighbor discovery packet from the PNDN, the secondary train warning device 26 shall reset the timer and begin counting down again.

While in discovery mode, SNDNs shall also broadcast a neighbor discovery packet like the PNDN discovery packet. Timing of the broadcast packet is critical to avoid collisions with other secondary train warning devices 26 and PNDN broadcasts. A train warning device 26 shall broadcast at the same rate the PNDN train warning device 26 is broadcasting discovery packets but offset by a random time. The offset time cannot exceed the PNDN broadcast interval rate. If desired, this offset rate can vary for each neighbor discovery packet if the implementing application desires. For example, if the PNDN interval rate is 2 seconds, the secondary train warning device 26 can broadcast anywhere from 0.01 to 1.99 seconds, picking a different offset each time the secondary train warning device 26 broadcasts. The packet header fields shall be set to the following:

Packet Destination ID: PNDN ID;
Packet Source ID: SNDN ID;
Hop Count: 0;
Hop Source ID: SNDN ID;
Hop Destination ID: Broadcast ID;
Packet ID: 0;
Sequence ID: 0, if implemented;
Domain ID+Payload Size if implemented.

The payload of the of the packet shall contain two fields:

Interval rate: the same value provided by the PNDN;

Train warning device 26 List: A list of the 2 lowest RPV discovered train warning devices 26 known by the SNDN. Each entry shall include the train warning device 26 ID and RPV assigned by the SNDN.

Processing Neighbor Discovery Packets

While both the PNDN and SNDN's are in discovery mode, they may only process neighbor discovery packets; all other packets shall not be processed. Train warning devices 26 may not process any neighbor discovery packets while not in discovery mode.

PNDN's shall only process packets from answering SNDN's. To ensure the PNDN processes the proper packets, the PNDN can use the following conditional check to determine if the packet is processable while in discovery mode:

1. Check Packet ID, ensure Packet ID is the value 0 to indicate neighbor discovery packet;
2. Check the Packet Destination ID, ensure Packet Destination ID matches the PNDN's train warning device 26 ID;
3. If conditions match, then the PNDN can process the packet.

SNDN's shall process packets from other SNDNs answering the PNDN and packets from the PNDN. To ensure the SNDN processes the proper packets, the SNDN can use the following conditional check to determine if the SNDN can process the packet while in discovery mode:

1. Check Packet ID, ensure Packet ID is the value 0 to indicate neighbor discovery packet;
2. The Packet Destination ID matches the initiating PNDN and Hop Destination is broadcast; or
3. The Packet Source ID matches the initiating PNDN and Destination ID is broadcast;
4. If conditions match, then the SNDN can process the packet.

When processing a neighbor discovery packet, the SNDN and PNDN shall:

Extract the train warning device 26 ID from the Packet Source ID;

Extract the Relative Position Value (RPV), either from the lower communications layer, or compute the RPV as needed;

Extract the train warning device 26 List from the payload (train warning device 26 ID+RPV).

When the above information is extracted, the train warning device 26 shall save the train warning device 26 information to the discovered train warning device 26 list by updating or inserting the extracted train warning device 26 information into the list.

Train Warning Device 26 Neighbor Discovery Commit

When discovery ends, each train warning device 26 (PNDN and SNDNs) shall move into neighbor discovery commit mode. The first step to this mode is to clear the current neighbor list. Next, the train warning device 26 may analyze the discovered train warning device 26 list and using an algorithm determine who its neighbors are. The algorithm works with a two-step process, each with their own complex algorithm to execute:

1. Find the two (2) train warning devices 26 with the lowest RPVs in the discovered train warning device 26 list, add them to a new list known as the tentative neighbor list;
2. Determine if the train warning device 26 is a terminating train warning device 26 or if the train warning device 26 can use both tentative neighbors as a neighbor.

Finding the two (2) train warning devices 26 with the lowest RPVs in the discovered train warning device 26 list is the first step. This process is simple and can be implemented in the most efficient way possible by the application. Store those in a new list called the tentative neighbor list.

Determining if the train warning device 26 is a terminating train warning device 26 is relatively straightforward. First, take the lowest RPV train warning device 26 from the tentative neighbor list and automatically assign as a neighbor, now known as the first neighboring train warning device 26. If there are no more train warning devices 26 in the tentative neighbor list, then the process is complete, and the train warning device 26 is a terminating train warning device 26 with one (1) neighbor. If one (1) train warning device 26 remains in the tentative neighbor list, then the train warning device 26 now needs to determine if the first neighboring train warning device 26 is closer to that train warning device 26 than itself. This is accomplished by comparing RPV values between the two train warning devices 26. If the first neighboring train warning device 26's RPV value is lower than this train warning device 26's RPV value, then the train warning device 26 is not a neighbor of this train warning device 26. Otherwise, the train warning device 26 is a neighbor and can be added to the neighbor list. A simple pseudo conditional check can be done:

Assume tentative_neighbor_list[0] was the first neighboring train warning device 26 added to the neighbor list:

```
LET train warning device 26 = tentative__neighbor__list[1]; // possible neighbor
IF train warning device 26.rssi <= tentative__neighbor__list[1].train warning devices 26[train warning device 26.id].rssi THEN
    // this is a neighbor, save it to our neighbor list
ELSE
  // this is not a neighbor, do not save to our neighbor list
END
```

Once those two steps are complete, train warning device 26 neighbor discovery commit mode is complete, and neighbors have been discovered and committed. Normal operations will begin again.

Packet Propagation

Packet propagation is the behavior of how packets are transported between train warning devices 26. There are three (3) types of propagation:

Uni-directional—a packet is propagating in one direction;

Bi-directional—a packet is propagating in two directions concurrently;

Broadcast—a packet is broadcast to nearby train warning devices 26 for reception.

Uni-Directional Packet Propagation

This is the process of sending a packet for propagation in one direction. There are two types of train warning devices 26 involved in this method: initiating train warning device 26 (IN), and propagating train warning device 26 (PN).

Initiating train warning device 26 (IN) is the train warning device 26 responsible for starting the propagation. It preferably determines the direction to propagate, who the destination is for, and how many hops to allow. Once determined, the train warning device 26 shall compose a packet and transmit with the following header fields:

Packet Destination ID: Destination ID of destination train warning device 26, or broadcast/neighborcast ID;

Packet Source: ID of the initiating train warning device 26;

Hop Count: set by the train warning device 26 as needed;

Hop Source: ID of the initiating train warning device 26;

Hop Destination ID: first hop neighbor ID;

Packet ID: the ID of the packet;

Sequence ID: sequence value as needed, if implemented;

Domain ID+Payload Size if implemented.

Propagation train warning device 26 (PN) is a train warning device 26 that receives a packet for its final destination or further propagation. This train warning device 26 shall follow the conditional check outlined in "Packet Reception and Processing" to determine if the packet can be processed further. If the packet passes, this train warning device 26 preferably checks if the packet is destined for itself. If the packet is destined for itself, then the propagation is complete. If not, the train warning device 26 preferably modifies the packet header, and transmit the packet for further propagation. If the hop count received is 0, then the train warning device 26 preferably ends propagation by not transmitting the packet any further. Otherwise, the following changes are made to the header and then the packet is transmitted again:

Packet Destination ID: Unmodified;

Packet Source ID: Unmodified;

Hop Count: decremented by 1;

Hop Source: ID of the propagating train warning device 26;

Hop Destination ID: next neighbor (chosen, by looking at the hop source ID before modifying the Hop Destination ID, see below)

Packet ID: Unmodified;

Sequence ID: Unmodified if implemented;

Domain ID+Payload Size unmodified if implemented.

The Hop Destination ID is determined by looking at the Hop Source ID from the original receiving packet. This may be one of the train warning devices 26 neighbors, we simply use the OTHER neighbor in the neighbor list. If no other neighbor exists, then the propagation stops. Otherwise, the neighbor ID is chosen, and the packet is transmitted for further propagation.

Bi-Directional Packet Propagation

This is the process of sending a packet for propagation in two directions at once. There are two types of train warning devices 26 involved in this method: initiating train warning device 26 (IN), and propagating train warning device 26 (PN).

Initiating train warning device 26 (IN) is the train warning device 26 responsible for starting the propagation. It preferably determines how many hops to allow in both directions. Once determined, the train warning device 26 shall compose a packet and transmit with the following header fields:

Packet Destination ID: Destination ID of destination train warning device 26, or broadcast/neighborcast ID;

Packet Source: ID of the initiating train warning device 26;

Hop Count: set by the train warning device 26 as needed;

Hop Source: ID of the initiating train warning device 26;

Hop Destination ID: Neighborcast ID;

Packet ID: the ID of the packet;

Sequence ID: sequence value as needed, if implemented;

Domain ID+Payload Size if implemented.

Just like Uni-directional Packet Propagation, the propagation train warning device 26 (PN) is a train warning device 26 that receives a packet for its final destination or further propagation. This train warning device 26 shall follow the conditional check outlined in "Packet Reception and Processing" to determine if the packet can be processed further. If the packet passes, this train warning device 26 preferably checks if the packet is destined for itself. If the packet is destined for itself, then the propagation is complete. If not, the train warning device 26 preferably modifies the packet header, and transmit the packet for further propagation. If the hop count received is 0, then the train warning device 26 preferably ends propagation by not transmitting the packet any further. Otherwise, the following changes are made to the header and the packet is transmitted again:

Packet Destination ID: Unmodified;

Packet Source ID: Unmodified;

Hop Count: decremented by 1;

Hop Source: ID of the propagating train warning device 26;

Hop Destination ID: next neighbor (chosen, by looking at the hop source ID before modifying Hop Destination ID, see below);

Packet ID: Unmodified;

Sequence ID: Unmodified if implemented;

Domain ID+Payload Size unmodified if implemented.

The Hop Destination ID is determined by looking at the Hop Source ID from the original receiving packet. This may be one of the train warning devices 26 neighbors, we simply use the OTHER neighbor in the neighbor list. If no other neighbor exists, then the propagation stops. Otherwise, the neighbor ID is chosen, and the packet is transmitted for further propagation.

Broadcasts

This is the process of sending a packet for local train warning devices 26 to receive. Propagation of this packet is left to the application implementation to decide in its packet processor. Care is preferably taken to ensure there is no broadcast storm.

Initiating train warning device 26 (IN) is the train warning device 26 responsible for starting the broadcast. It shall compose a packet and transmit with the following header fields:

Packet Destination ID: Broadcast ID;

Packet Source: ID of the initiating train warning device 26;

Hop Count: always 0;

Hop Source: ID of the initiating train warning device 26;

Hop Destination ID: Broadcast ID;

Packet ID: the ID of the packet;

Sequence ID: sequence value as needed, if implemented;

Domain ID+Payload Size if implemented.

Note that the hop count is always 0 for broadcast packets to indicate the packet shall not be propagated.

Resilience Protocol

To account for faults in the system and keeping propagation moving forward, a resilience protocol may be baked into NPP. Neighboring train warning devices 26 shall listen for packets destined to neighbors and automatically resume processing if the neighbor is determined to not be propagating the packet properly. To determine if a packet is not propagating correctly, the neighboring train warning device 26 shall:

Listen for packets destined to one of its neighbor train warning devices 26, by inspecting receiving packet headers to determine if the neighbor should be propagating the packet further;

Run a countdown timer, if the timer reaches zero the train warning device 26 shall modify the received packet as if the neighbor propagated the packet and resume normal processing;

If any packet is received from that neighboring train warning device 26, the countdown timer shall be stopped.

Railway Safety

NPP Implementation

The railway safety system may utilize NPP as the communication protocol for all messages between train warning devices 26.

There may be two (2) NPP chain domains, one (1) for each side of the track. These domains can be on separate frequencies or on the same. If on the same frequency, implementation preferably uses Domain IDs in all NPP packet headers.

Train warning device 26 IDs shall be auto assigned by hardware/firmware if possible; manual assignment shall always be permitted. These IDs shall be saved in non-volatile memory to survive power loss and resets.

Security

NPP packets may be encrypted by the implementing application. The encryption used is up to the implementing application.

Packets

This section lists the minimum packets needed to operate the railways system; other packets may be required to service the system at a future date.

Train Warning Device 26 State Packet

When a train warning device 26 changes state, and at a set interval, the train warning device 26 shall send a bi-directional packet to its neighbors indicating what state the train warning device 26 is or changed to. The hop count of this packet shall be set to 0, so the packet does not propagate. The packet shall provide the new state in the payload.

Train Detection Packet/Message

When a train warning device 26 senses a train presence, the train warning device 26 shall generate and send a Train Detection Packet/Message. This packet may continue to be sent at a set interval while the train warning device 26 senses a trains presence. This packet shall use the NPP to propagate the detection to other train warning devices 26. The method used to propagate shall differ depending on if the train warning device 26 is able to resolve the travel direction of the train:

If the train warning device 26 can resolve the trains travel direction by referencing its train origin ID, the train warning device 26 shall propagate as a uni-directional packet moving in the direction of travel.

If the train warning device 26 cannot resolve the trains travel direction because train origin ID is not set, the train warning device 26 shall propagate as a bi-directional packet moving in both directions.

The payload of this packet shall include hop count state information, that will provide receiving train warning devices 26 information needed to set their current train state after receiving the Train Detection Packet. The payload may consist of a list of train states and hop count pairs, such as Leading Imminent and Leading states, as illustrated in Table 1 below. The hop count associated with each train state shall indicate to the receiving train warning device 26 the threshold hop count for each train state. See further below for an example train detection message and example processing by train warning devices 26.

When the train warning device 26 no longer senses a trains presence, the train warning device 26 shall stop sending the Train Detection Packet.

All train warning devices 26 that sense a train shall ignore Train Detection Packets from other train warning devices 26 and continue to only generate and transmit its own Train Detection Packet.

The hop count in the originating Train Detection Packet shall be determined by the implementing application and may be user configurable, so that factors such as train warning device 26 density and local regulations may be considered. Thus, train warning devices 26 in rural locations may be configured differently from train warning devices 26 in urban locations. For example, train warning devices 26 in rural locations may provide less warning than those in urban locations if desired. Thus, the hop count may differ between train warning devices 26 as desired.

As train warning devices 26 receive the Train Detection Packet, they shall inspect the payload and header Hop Count to determine what current train state they shall be in. A few examples are demonstrated below:

TABLE 1

| Header: Hop Count | Payload State Hop Counts | Resulting State |
|---|---|---|
| 35 | Leading Imminent: 30<br>Leading: 0 | Leading Imminent |
| 30 | Leading Imminent: 30<br>Leading: 0 | Leading Imminent |

TABLE 1-continued

| Header: Hop Count | Payload State Hop Counts | Resulting State |
|---|---|---|
| 25 | Leading<br>Imminent: 30<br>Leading: 0 | Leading |
| 0 | Leading<br>Imminent: 30<br>Leading: 0 | Leading |

In the example presented in table 1, a train warning device 26 that detects a train passing over the train warning device 26 generates a train detection message and sets a hop count to 35. This indicates that the train detection message will be communicated to 35 downstream train warning devices 26, each of which will receive the train detection message, determine their current train state based on the train detection message, decrement the hop count, and, if the hop count is greater than zero, propagate the message to the next downstream warning device 26. As an example, the first downstream train warning device 26 that neighbors the train warning device 26 that originates the train detection message receives the train detection message. The first downstream train warning device 26 determines that the hop count is 35. The first downstream train warning device 26 determines that the payload indicates that any downstream train warning device 26 that receives the train detection message and the train detection message at the time of receipt has a hop count equal to 30 or above, should set their current train state to a leading imminent train state. The first downstream train warning device 26 sets the current train state of the first downstream train warning device 26 to the leading imminent train state. In this example, the leading imminent train state corresponds to the color red, and the first downstream train warning device 26 causes the corresponding light assembly 30 to emit a red color. The first downstream train warning device 26 then decrements the hop count to 34 and communicates the train detection message to the immediate neighboring downstream train warning device 26, which repeats this process.

As a further example, a downstream train warning device 26 eventually receives the train detection message and the train detection message has a hop count of 25. The downstream train warning device 26 determines that the payload indicates that any downstream train warning device 26 that receives the train detection message and the train detection message at the time of receipt has a hop count greater than zero and less than 30, should set their current train state to a leading train state. The downstream train warning device 26 sets the current train state of the downstream train warning device 26 to the leading train state. In this example, the leading train state corresponds to the color yellow, and the downstream train warning device 26 causes the corresponding light assembly 30 to emit a yellow color. The downstream train warning device 26 then decrements the hop count to 24 and communicates the train detection message to the immediate neighboring downstream train warning device 26, which repeats this process. Train warning devices 26 beyond the hop count remain in the idle train state, which, in some examples, corresponds to the color green.

Trains

Each train warning device 26 may keep track of the state of the train on the track, if known. This may be done, for example, by using a detection system to detect presence of a train next to the train warning device 26, or by receiving messages from other train warning devices 26 indicating the trains position.

State Machine

Each train warning device 26 shall contain a state machine to keep track of the known state of the train. There are six (6) possible states:

- Idle: The train warning device 26 does not sense a train nearby and has no indication that one may be present anytime soon. This is the default state of all train warning devices 26;
- Occupied: the train warning device 26 senses a train on top of itself and the train warning device 26 knows which direction the train is traveling;
- Occupied Blind: the train warning device 26 senses a train on top of itself, but the train warning device 26 does not know what direction the train is traveling;
- Leading Imminent: the train warning device 26 has been notified that a train is on the way and is expected very soon;
- Leading: the train warning device 26 has been notified that a train is on the way and nearby;
- Departing: this state occurs after a train warning device 26 no longer senses the train on top of itself.

Fault Correction

All train warning devices 26 shall return to the idle state if they have not received a Train Detection Packet after a specified period. To accomplish this, each train warning device 26 should implement a countdown timer and move into an idle state once this timer reaches 0. If the train warning device 26 receives a Train Detection Packet before the timer finishes, this timer shall be reset and begin counting down again.

When returning to an idle state, each train warning device 26 shall clear their train origin ID.

Detection System

A detection mechanism that can be triggered by audio, video, laser/radio wave, vibrations, specialized sensors, or instructed by an external service or trigger, shall provide train warning devices 26 information for when a train is detected at the train warning device 26.

Travel Direction Resolution

Exploiting NPP, train warning devices 26 shall use the header information from Train Detection Packets to determine which direction the train will be traveling. Each train warning device 26 shall record the Hop Source ID as the train origin ID. This may be used when the train is sensed at the train warning device 26, so the train warning device 26 knows how to propagate its Train Detection Packet.

While the train warning device 26 is in an Occupied Blind state, if a neighboring train warning device 26 moves into an Occupied state then Occupied Blind train warning device 26 shall resolve the trains travel direction by settings its train origin ID to its other neighbor.

Detecting Direction Changes

Direction changes may be corrected without the need of any special systems in place utilizing current train warning device 26 behaviors. The result will be train warning devices 26 in the original direction maintaining their states until they timeout from no longer receiving a Train Detection Packet and the new direction of train warning devices 26 receiving a new Train Detection Packet once the train moves to the first train warning device 26 in the new direction.

Stopped Train Detection

While in an occupied, or occupied blind, state, train warning devices 26 shall stop transmitting Train Detection Packets at a specified period even if the train warning device 26 continues to sense a train. This period shall be set by the implementing application so that factors like train warning device 26 density, and local variables and regulations, can be considered in how this should behave.

Pedestrians

Each train warning device 26 shall keep track of the proximity state of pedestrians, if known. This may be done, by way of non-limiting example, by using a proximity detection system.

Train warning devices 26 may interact with pedestrians by providing visual cues on the state of the railway. The visual cues may differ depending on the state of the train warning device 26 and proximity of the pedestrian to the train warning device 26.

State Machine

There are two (2) possible states:

Clear: the train warning device 26 does not sense a pedestrian near proximity. This is the default state of all train warning devices 26.

Sensed: the train warning device 26 senses a pedestrian near proximity.

Detection System

A detection mechanism that can be triggered by audio, video, laser/radio wave, vibrations, specialized sensors, or instructed by an external service or trigger, shall provide train warning devices 26 information for when a pedestrian is detected near proximity.

Visual Cues

Visual cues may be anything that can mutate to indicate a different state to pedestrians, such as an RGB light indicator. Visual cues shall change when the train or pedestrian states change.

The following table may be used as a reference to demonstrate one (1) possible set of cues to indicate a state to pedestrian but is not limited to just these specific cues. The cue system used can be adapted to meet a familiar visual cue system for the localized area of installation.

TABLE 2

| | Pedestrian Clear | Pedestrian Sensed |
|---|---|---|
| Train Idle | Solid GREEN LEDs | Solid GREEN LEDs |
| Train Occupied | Solid RED LEDs | Flashing RED/WHITE LEDs |
| Train Occupied Blind | Solid RED LEDs | Flashing RED/WHITE LEDs |
| Train Leading Imminent | Solid RED LEDs | Flashing RED/WHITE LEDs |
| Train Leading | Solid AMBER LEDs | Flashing AMBER/WHITE LEDs |
| Train Departing | Solid RED LEDs | Flashing RED/WHITE LEDs |

Figure 9:
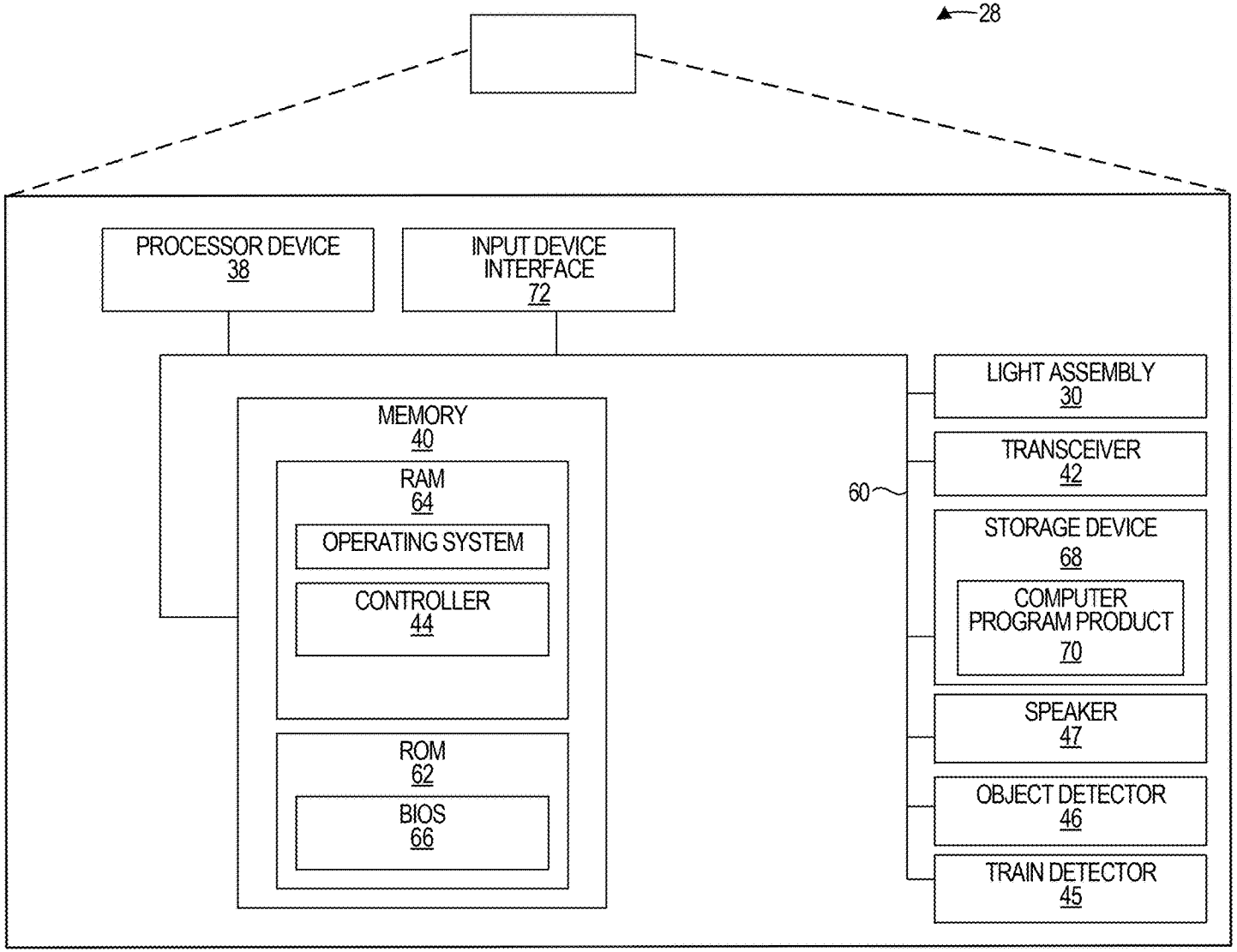
FIG. 9 is a block diagram of a computing device suitable for implementing examples according to one example.

FIG. 9 is a block diagram of the computing device 28 suitable for implementing examples according to one example. The computing device 28 may comprise any computing or electronic device capable of including firmware, hardware, and/or executing software instructions to implement the functionality described herein. The computing device 28 may be in a weatherproof package. The computing device 28 includes the processor device 38, the system memory 40, and a system bus 60. The system bus 60 provides an interface for system components including, but not limited to, the system memory 40 and the processor device 38. The processor device 38 can be any commercially available or proprietary processor device.

The system bus 60 may be any of several types of bus structures that may further interconnect to a memory bus (with or without a memory controller), a peripheral bus, and/or a local bus using any of a variety of commercially available bus architectures. The system memory 40 may include non-volatile memory 62 (e.g., read-only memory (ROM), erasable programmable read-only memory (EPROM), electrically erasable programmable read-only memory (EEPROM), etc.), and volatile memory 64 (e.g., random-access memory (RAM)). A basic input/output system (BIOS) 66 may be stored in the non-volatile memory 62 and can include the basic routines that help to transfer information between elements within the computing device 28. The volatile memory 64 may also include a high-speed RAM, such as static RAM, for caching data.

The computing device 28 may further include or be coupled to a non-transitory computer-readable storage medium such as a storage device 68, which may comprise, for example, an internal or external hard disk drive (HDD) (e.g., enhanced integrated drive electronics (EIDE) or serial advanced technology attachment (SATA)), HDD (e.g., EIDE or SATA) for storage, flash memory, or the like. The storage device 68 and other drives associated with computer-readable media and computer-usable media may provide non-volatile storage of data, data structures, computer-executable instructions, and the like.

A number of modules can be stored in the storage device 68 and in the volatile memory 64, including an operating system and one or more program modules, such as the controller 44, which may implement the functionality described herein in whole or in part. All or a portion of the examples may be implemented as a computer program product 70 stored on a transitory or non-transitory computer-usable or computer-readable storage medium, such as the storage device 68, which includes complex programming instructions, such as complex computer-readable program code, to cause the processor device 38 to carry out the steps described herein. Thus, the computer-readable program code can comprise software instructions for implementing the functionality of the examples described herein when executed on the processor device 38. The processor device 38, in conjunction with the controller 44 in the volatile memory 64, may serve as a controller, or control system, for the computing device 28 that is to implement the functionality described herein.

An operator may also be able to enter one or more configuration commands through a keyboard (not illustrated), input buttons, or wirelessly. Such input devices may be connected to the processor device 38 through an input device interface 72 that is coupled to the system bus 60 but can be connected by other interfaces such as a parallel port, an Institute of Electrical and Electronic Engineers (IEEE) 1394 serial port, a Universal Serial Bus (USB) port, an IR interface, and the like. The computing device 28 also includes the one or more transceivers 42 suitable for communicating with other devices. The computing device 28 may include, or be communicatively coupled to, the light assembly 30, object detector 46 and train detector 45.

Other computer system designs and configurations may also be suitable to implement the systems and methods described herein. The following examples illustrate various additional implementations in accordance with one or more aspects of the disclosure.

Example 1 is a method comprising: determining, by a first train warning device comprising a computing device and a light assembly that is coupled to a railroad track and that is operable to emit light in a plurality of different colors, a current train state of a plurality of different train states at a first location; and, in response to determining that the current train state is a first train state of the plurality of different train states, causing the light assembly to emit a first color of the plurality of different colors emittable by the light assembly.

Example 2 is the method of example 1 further comprising: subsequently determining, by the first train warning device, the current train state at the first location, wherein the current train state is a second train state, the second train state differing from the first train state; and, in response to determining that the current train state is the second train state, causing the light assembly to emit a second color of the plurality of different colors emittable by the light assembly.

Example 3 is the method of example 2 wherein the first train state comprises an idle state indicating that no train will be at the first location within a predetermined amount of time or is at least a first predetermined distance away, and the second train state is a leading state indicating that a train is approaching the first location and the train is at least a second predetermined distance from the first location or at least a first predetermined amount of time from the first location.

Example 4 is the method of example 3 further comprising: subsequently determining, by the first train warning device, the current train state at the first location, wherein the current train state is a third train state, the third train state differing from the first train state and the second train state; and, in response to determining that the current train state is the third train state, causing the light assembly to emit a third color of the plurality of different colors emittable by the light assembly.

Example 5 is the method of example 4 wherein the third train state comprises an occupied state indicating that a train is within a second predetermined distance of the first location or within a second predetermined amount of time from the first location.

Example 6 is the method of example 1 further comprising: determining, by the first train warning device, that an object is within a first predetermined distance of the railroad track; and, in response to determining that the object is within the first predetermined distance from the railroad track, causing the light assembly to emit a first warning light signal.

Example 7 is the method of example 6 wherein the first warning light signal is a pulsing of the first color at a first pulse rate.

Example 8 is the method of example 7 further comprising: determining, by the first train warning device, that the object is within a second predetermined distance of the railroad track that is closer to the railroad track than the first predetermined distance; and, in response to determining that the object is within the second predetermined distance from the railroad track, causing the light assembly to emit a second warning light signal.

Example 9 is the method of example 8 wherein the second warning light signal is a pulsing of the first color at a second pulse rate that is a quicker pulse rate than the first pulse rate.

Example 10 is the method of example 1 further comprising: determining, by the first train warning device, that an object is within a first predetermined distance of the railroad track; and, in response to determining that the object is within the first predetermined distance from the railroad track, causing a sound to be emitted.

Example 11 is the method of example 1 wherein the first train warning device comprises a first train warning device of a plurality of train warning devices, each of the plurality of train warning devices being coupled to a corresponding light strip that is coupled to the railroad track, and further comprising: receiving, by the first train warning device, a message originating from an upstream train warning device, the message indicating the location of the train; and wherein determining the current train state at the first location comprises determining that an oncoming train is a first distance from the first location based on the message.

Example 12 is the method of claim 11 further comprising: transmitting, by the first train warning device to a second train warning device of the plurality of train warning device that is farther from the oncoming train than the first train warning device, the message.

Example 13 is the method of claim 1 further comprising: receiving, by the first train warning device, a message originating from a computing device that tracks a real-time locations of a train on the railroad track, a message indicating the location of the train; and wherein determining the current train state at the first location comprises determining that an oncoming train is a first distance from the first location based on the message.

Individuals will recognize improvements and modifications to the preferred examples of the disclosure. All such improvements and modifications are considered within the scope of the concepts disclosed herein and the claims that follow.

What is claimed is:

1. A method comprising:

determining, by a first train warning device comprising a computing device and a light assembly that is coupled to a railroad track and that is operable to emit light in a plurality of different colors, a current train state of a plurality of different train states at a first location, wherein the first train warning device is one of a plurality of train warning devices, each train warning device comprising a computing device and a light assembly coupled to the railroad track, and wherein determining the current train state comprises receiving, by the first train warning device from an upstream train warning device, a train detection message, the train detection message indicating a state to which the first train warning device is to set the current train state of the first train warning device;

in response to determining that the current train state is a first train state of the plurality of different train states, causing the light assembly to emit a first color of the plurality of different colors emittable by the light assembly;

decrementing, by the first train warning device, a hop count identified in the train detection message;

determining that the hop count is greater than zero; and in response to determining that the hop count is greater than zero, transmitting the train detection message, by the first train warning device to a neighboring downstream train warning device of the plurality of train warning devices that is farther from a detected train than the first train warning device.

2. The method of claim 1 further comprising:

subsequently determining, by the first train warning device, the current train state at the first location, wherein the current train state is a second train state, the second train state differing from the first train state; and in response to determining that the current train state is the second train state, causing the light assembly to emit a second color of the plurality of different colors emittable by the light assembly.

3. The method of claim 2 wherein the first train state comprises an idle state indicating that, subsequent to a previous train passing over the first train warning device, the first train warning device has not received a message from an upstream train warning device of a plurality of upstream train warning devices indicating that a train is approaching the first location.

4. The method of claim 2 wherein subsequently determining, by the first train warning device, the current train state at the first location, wherein the current train state is the second train state, the second train state differing from the first train state further comprises:

receiving, by the first train warning device from a first upstream train warning device, a first train detection message, the first train detection message indicating that the current train state of the first train warning device is to be set to the second train state.

5. The method of claim 4 further comprising:

subsequently determining, by the first train warning device, the current train state at the first location, wherein the current train state is a third train state, the third train state differing from the first train state and the second train state; and in response to determining that the current train state is the third train state, causing the light assembly to emit a third color of the plurality of different colors emittable by the light assembly.

6. The method of claim 5 wherein subsequently determining, by the first train warning device, the current train state at the first location, wherein the current train state is the third train state, the third train state differing from the first train state and the second train state further comprises:

receiving, by the first train warning device from a second upstream train warning device, a second train detection message, the second train detection message indicating that the current train state of the first train warning device is to be set to the third train state.

7. The method of claim 1 further comprising:

determining, by the first train warning device, that an object is within a first predetermined distance of the railroad track; and in response to determining that the object is within the first predetermined distance from the railroad track, causing the light assembly to emit a first warning light signal.

8. The method of claim 7 wherein the first warning light signal is a pulsing of the first color at a first pulse rate.

9. The method of claim 8 further comprising:

determining, by the first train warning device, that the object is within a second predetermined distance of the railroad track that is closer to the railroad track than the first predetermined distance; and in response to determining that the object is within the second predetermined distance from the railroad track, causing the light assembly to emit a second warning light signal, wherein the second warning light signal is a pulsing of the first color at a second pulse rate that is a quicker pulse rate than the first pulse rate.

10. The method of claim 1 further comprising:

determining, by the first train warning device, that an object is within a first predetermined distance of the railroad track; and in response to determining that the object is within the first predetermined distance from the railroad track, causing a sound to be emitted.

11. The method of claim 1 wherein the light assembly comprises a light strip comprising a plurality of LED lights, the light strip being coupled to the railroad track.

12. The method of claim 1 wherein the light assembly is coupled to a web of the railroad track.

13. The method of claim 1 wherein the computing device is coupled to a web of the railroad track.

14. The method of claim 1 further comprising:

receiving, by the computing device, a message originating from a computing device that tracks a real-time location of a train on the railroad track, a message indicating a location of the train; and wherein determining the current train state at the first location comprises determining that an oncoming train is a first distance from the first location based on the message.

15. The method of claim 1 further comprising:

determining, by the first train warning device, that a train is passing over the first location;

in response to determining that the train is passing over the first location, generating, by the first train warning device, a train detection message;

inserting, by the first train warning device into the train detection message, a hop count value that identifies a number of train warning devices of a plurality of downstream train warning devices to which the train detection message is to be propagated; and inserting, into the train detection message, a first train state to which a first plurality of the plurality of downstream train warning devices is to set corresponding current train states and a second train state to which a second plurality of the plurality of downstream train warning devices is to set corresponding current train states.

16. A train warning system comprising:

a first train warning device comprising:

a light assembly operable to emit light in a plurality of different colors, the light assembly being configured to be coupled to a railroad track at a first location;

a computing device communicatively coupled to the light assembly, the computing device operable to:

determine a current train state of a plurality of different train states at the first location, wherein the current train state is a first train state of the plurality of different train states, wherein the first train warning device is one of a plurality of train warning devices, each train warning device comprising a computing device and a light assembly coupled to the railroad track, and wherein to determine the current train state the computing device is operable to receive, from an upstream train warning device, a train detection message, the train detection message indicating a state to which the first train warning device is to set the current train state of the first train warning device;

in response to determining that the current train state is the first train state, cause the light assembly to emit a first color of the plurality of different colors emittable by the light assembly;

decrement a hop count identified in the train detection message;

determine that the hop count is greater than zero; and in response to determining that the hop count is greater than zero, transmit the train detection message to a neighboring downstream train warning device of the plurality of train warning devices that is farther from a detected train than the first train warning device.

17. A method comprising:

determining, by a first train warning device comprising a computing device and a light assembly that is coupled to a railroad track and that is operable to emit light in a plurality of different colors, a current train state of a plurality of different train states at a first location;

in response to determining that the current train state is a first train state of the plurality of different train states, causing the light assembly to emit a first color of the plurality of different colors emittable by the light assembly;

determining, by the first train warning device, that a train is passing over the first location;

in response to determining that the train is passing over the first location, generating, by the first train warning device, a train detection message;

inserting, by the first train warning device into the train detection message, a hop count value that identifies a number of train warning devices of a plurality of downstream train warning devices to which the train detection message is to be propagated; and inserting, into the train detection message, a first train state to which a first plurality of the plurality of downstream train warning devices is to set corresponding current train states and a second train state to which a second plurality of the plurality of downstream train warning devices is to set corresponding current train states.

18. A train warning system comprising:

a first train warning device comprising:

a light assembly operable to emit light in a plurality of different colors, the light assembly being configured to be coupled to a railroad track at a first location;

a computing device communicatively coupled to the light assembly, the computing device operable to:

determine a current train state at the first location, wherein the current train state is a first train state;

in response to determining that the current train state is the first train state, cause the light assembly to emit a first color of the plurality of different colors emittable by the light assembly;

determine that a train is passing over the first location;

in response to determining that the train is passing over the first location, generate a train detection message;

insert, into the train detection message, a hop count value that identifies a number of train warning devices of a plurality of downstream train warning devices to which the train detection message is to be propagated; and insert, into the train detection message, a first train state to which a first plurality of the plurality of downstream train warning devices is to set corresponding current train states and a second train state to which a second plurality of the plurality of downstream train warning devices is to set corresponding current train states.

19. A method comprising:

determining, by a first train warning device comprising a computing device and a light assembly that is coupled to a railroad track and that is operable to emit light in a plurality of different colors, a current train state of a plurality of different train states at a first location;

in response to determining that the current train state is a first train state of the plurality of different train states, causing the light assembly to emit a first color of the plurality of different colors emittable by the light assembly;

determining, by the first train warning device, that an object is within a first predetermined distance of the railroad track;

in response to determining that the object is within the first predetermined distance from the railroad track, causing the light assembly to emit a first warning light signal, wherein the first warning light signal is a pulsing of the first color at a first pulse rate;

determining, by the first train warning device, that the object is within a second predetermined distance of the railroad track that is closer to the railroad track than the first predetermined distance; and in response to determining that the object is within the second predetermined distance from the railroad track, causing the light assembly to emit a second warning light signal, wherein the second warning light signal is a pulsing of the first color at a second pulse rate that is a quicker pulse rate than the first pulse rate.

20. A train warning system comprising:

a first train warning device comprising:

a light assembly operable to emit light in a plurality of different colors, the light assembly being configured to be coupled to a railroad track at a first location;

a computing device communicatively coupled to the light assembly, the computing device operable to:

determine a current train state at the first location, wherein the current train state is a first train state; and in response to determining that the current train state is the first train state, cause the light assembly to emit a first color of the plurality of different colors emittable by the light assembly;

determine that an object is within a first predetermined distance of the railroad track;

in response to determining that the object is within the first predetermined distance from the railroad track, cause the light assembly to emit a first warning light signal, wherein the first warning light signal is a pulsing of the first color at a first pulse rate;

determine that the object is within a second predetermined distance of the railroad track that is closer to the railroad track than the first predetermined distance; and in response to determining that the object is within the second predetermined distance from the railroad track, cause the light assembly to emit a second warning light signal, wherein the second warning light signal is a pulsing of the first color at a second pulse rate that is a quicker pulse rate than the first pulse rate.

* * * * *